US005174667A

United States Patent [19]

Sugimoto et al.

[11] Patent Number: 5,174,667

[45] Date of Patent: Dec. 29, 1992

[54] TRANSFER PRINTER

[75] Inventors: Kazuaki Sugimoto, Numazu; Osamu Koizumi, Shizuoka; Ikuzo Sugiura, Sagamihara; Satoshi Kitahara, Mishima, all of Japan

[73] Assignee: Tokyo Electric Co., Ltd., Tokyo, Japan

[21] Appl. No.: 675,984

[22] Filed: Mar. 26, 1991

[30] Foreign Application Priority Data

| | | | |
|---|---|---|---|
| Mar. 30, 1990 | [JP] | Japan | 2-83952 |
| Mar. 30, 1990 | [JP] | Japan | 2-83956 |
| Mar. 30, 1990 | [JP] | Japan | 2-83959 |

[51] Int. Cl.[5] ..... B41J 35/28

[52] U.S. Cl. ..... 400/207; 400/120; 400/208.1; 400/196.1; 400/692

[58] Field of Search ..... 400/207, 208, 208.1, 400/196.1, 120, 246, 207 E, 692

[56] References Cited

U.S. PATENT DOCUMENTS

| | | | |
|---|---|---|---|
| 4,027,765 | 6/1977 | Crump et al. | 197/133 R |
| 4,408,914 | 10/1983 | Ciesiel | 400/208 |
| 4,423,974 | 1/1984 | Müller | 400/242 |
| 4,534,666 | 8/1985 | Watanabe | 400/207 |
| 4,632,585 | 12/1986 | Oyamatsu | 400/613 |
| 4,641,980 | 2/1987 | Matsumoto | 400/120 |
| 4,673,304 | 6/1987 | Liu | 400/208 |
| 4,776,714 | 10/1988 | Sugiura | 400/248 |
| 4,797,690 | 1/1989 | Takita | 346/105 |
| 4,855,755 | 8/1989 | Aizawa | 346/76 PH |
| 4,934,847 | 6/1990 | Shiozaki et al. | 400/120 |
| 4,944,619 | 7/1990 | Suzuki | 400/224.2 |
| 4,984,915 | 1/1991 | Tashiro et al. | 400/613 |
| 5,061,100 | 10/1991 | Brouwer | 400/642 |

FOREIGN PATENT DOCUMENTS

| | | | |
|---|---|---|---|
| 0311981 | 4/1989 | European Pat. Off. . | |
| 3228569 | 2/1984 | Fed. Rep. of Germany . | |
| 3712114 | 10/1987 | Fed. Rep. of Germany | 400/692 |
| 2403888 | 4/1979 | France . | |
| 55-114587 | 9/0180 | Japan . | |
| 245574 | 12/1985 | Japan | 400/208 |
| 64479 | 4/1986 | Japan | 400/692 |
| 68277 | 4/1986 | Japan | 400/692 |
| 132368 | 6/1986 | Japan | 400/692 |
| 188173 | 8/1986 | Japan | 400/692 |
| 287777 | 12/1986 | Japan | 400/208 |
| 2005024 | 9/1977 | United Kingdom . | |

OTHER PUBLICATIONS

Patent Abstracts of Japan, Unexamined Applications, vol. 7, No. 102, Apr. 30, 1983, p. 143 M 211, the Patent Office Japanese Government.

*Primary Examiner*—Edgar S. Burr
*Assistant Examiner*—Eric P. Raciti
*Attorney, Agent, or Firm*—Frishauf, Holtz, Goodman & Woodward

[57] ABSTRACT

A label printer comprises a supporting frame having a pair of side plates facing each other. A print head and a platen roller are arranged between the side plates. Above the print head is arranged a ribbon supply device for running a transfer ribbon between the print head and the platen roller. The ribbon supply device includes a ribbon unit supported on a supporting mechanism, and a ribbon drive section attached to the side plate so as to drive the ribbon unit. The supporting mechanism includes a fixed arm fixed to the side plate, and a slider mounted on the fixed arm. The slider supports the ribbon unit thereon and is slidable between a first position where the ribbon unit engages the ribbon drive section and a second position where the ribbon unit is situated outside the supporting frame.

21 Claims, 15 Drawing Sheets

TRANSFER PRINTER

BACKGROUND OF THE INVENTION

1. Field of the Invention

The present invention relates to a transfer printer, such as a label printer for printing item names, bar codes, etc. on labels, and more particularly, to a transfer printer in which a transfer ribbon in contact with printing paper is heated by means of a print head to transfer ink on the ribbon to the paper, thereby effecting printing.

2. Description of the Related Art

A transfer printer, e.g., a label printer for printing item names, bar codes, etc. on labels, comprises a printing section which includes a platen roller and a line thermal head adapted to be pressed against the roller. A supply shaft and a take-up shaft for a transfer ribbon are located over the printing section. When the take-up shaft is rotated by means of a motor and the like, the transfer ribbon is fed out from the supply shaft, transported past a guide shaft and the printing section, and taken up by means of the take-up shaft. The supply shaft is connected with a load mechanism. A desired back tension is applied to the transfer ribbon by damping the rotation of the supply shaft by means of the load mechanism.

Conventionally, attaching and detaching operations for replacing the transfer ribbon, must be performed in a narrow space within the printer body, while avoiding interfering with other components, so that the working efficiency is not very high.

A printer of a novel design has recently been developed to facilitate the replacement of the transfer ribbon. In this printer, a supply shaft and a take-up shaft wound with a ribbon are housed in a casing to form a modular structure or unit, which is removably mounted in the body of the printer. According to this arrangement, the transfer ribbon can be replaced outside the printer by removing the unit from the printer body.

If the prior art transfer ribbon and the supply and take-up shafts are combined into the unit, the replacement of the ribbon itself can be significantly facilitated. Nevertheless, the ribbon unit must be attached to or detached from the printer in the narrow space within the printer body, so that the working efficiency is not satisfactory. Thus, it is hard to utilize the ribbon unit with high efficiency.

In the ribbon unit, both the supply shaft and the take-up shaft include a ribbon set shaft and a cylindrical core removably mounted on the set shaft. The transfer ribbon is wound on the core.

A core fixing portion in the prior art is formed on one end portion of the ribbon set shaft, and a core stopper portion is formed on the other end portion. One end portion of the core is removably fitted on the fixing portion, so that the core is prevented from moving radially and axially toward the one end side with respect to the ribbon set shaft. The stopper portion is releasably engaged with the other end of the core so that the core is held between the stopper portion and the fixing portion, whereby the core is prevented from moving toward the other end of the set shaft. Thus, the core is supported on the ribbon set shaft by means of these two portions, and is rotated together with the set shaft.

The core fixing portion and the core stopper portion, are provided individually at the two opposite ends of the ribbon set shaft; both are immovable, and the distance between these portions is previously set in accordance with the width of the transfer ribbon to be used. In other words, the distance between the two portions is not adjustable.

Currently available transfer ribbons have widths of two, three, four, and six inches. In the conventional printer, however, the ribbon set shaft is adapted to be used exclusively for a specific transfer ribbon, as mentioned above. Accordingly transfer ribbons having widths which conform to the different widths of various printing papers cannot be set on one and the same ribbon set shaft. If a transfer ribbon of 4-inch width is used, for example, part of it can be used for printing on papers of widths smaller than its width. In this case, however, the ribbon is consumed wastefully.

Also in this respect, therefore, the ribbon unit cannot be efficiently utilized.

SUMMARY OF THE INVENTION

The present invention has been developed in consideration of these circumstances, and its object is to provide a transfer printer which ensures efficient use of a ribbon unit, including higher-efficiency attachment and detachment of the transfer ribbon, effective use of various transfer ribbons, etc.

In order to achieve the above object, a transfer printer according to the present invention comprises: a main body; printing means including a print head arranged in the main body and a platen roller in contact with the print head, for printing information on a recording medium transported between the print head and the platen roller; a ribbon supply device for supplying a transfer ribbon between the print head and the recording medium, the ribbon supply device including a ribbon unit, having the transfer ribbon and first and second rotating shafts wound with the transfer ribbon, and a ribbon drive section in the main body for driving the ribbon unit; and supporting means arranged in the main body, for supporting the ribbon unit so that the ribbon unit is movable between a first position in which the ribbon unit engages the ribbon drive section and a second position in which the ribbon unit is situated outside the main body.

According to the printer constructed in this manner, the ribbon unit can be taken out from the main body by only being moved from the first position to the second position by means of the supporting means. The transfer ribbon can be replaced while the ribbon unit is outside the main body. In doing this, the ribbon can be replaced more easily if the ribbon unit is removably mounted on the supporting means. After the replacement of the ribbon, the ribbon unit is moved to the first position and engaged with the drive section by means of the supporting means. In this manner, the unit can be easily reset in the printer. Thus, the ribbon unit can be utilized with high efficiency.

According to the present invention, moreover, there is provided a transfer printer which comprises: a main body; printing means including a print head disposed in the casing and a platen roller in contact with the print head, for printing information on a recording medium passing between the print head and the platen roller; and a ribbon supply device for supplying a transfer ribbon through between the print head and the recording medium, the ribbon supply device including a ribbon unit having the transfer ribbon and supply and take-up shafts wound with the transfer ribbon, and a ribbon drive section attached to the main body, for driving the ribbon unit. Each of the supply shaft and the take-up shaft of the ribbon unit includes: a ribbon set shaft; a cylindrical first core removably mounted on the ribbon set shaft and extending substantially parallel thereto, the first core being wound with the transfer ribbon and having a predetermined length; positioning means provided at one end portion of the ribbon set shaft, for engaging one end of the first core mounted on the ribbon set shaft so as to position the one end of the first core with respect to the ribbon set shaft; holding means provided at the other end portion of the ribbon set shaft so as to be situated at a distance substantially equal to the length of the first core from the positioning means, for elastically engaging the other end of the first core to hold the same; an engaging portion provided on the ribbon set shaft between the positioning means and the retaining means; a second core adapted to be mounted on the ribbon set shaft in place of the first core and wound with another transfer ribbon narrower than the first transfer ribbon, the second core being shorter in length than the first core and having one end portion for engaging the holding means; and auxiliary positioning means removably mounted on the ribbon set shaft while being positioned by the engaging portion, for engaging the other end of the second core so as to position the other end of the second core.

According to the printer constructed in this manner, the distance between the positioning means at the one end portion of the ribbon set shaft and the core holding means at the other end portion of the set shaft is substantially equal to the length of the first core or the width of the transfer ribbon adapted to be wound around the first core. If the transfer ribbon with the aforesaid width is set on the ribbon set shaft, therefore, the first core is mounted onto the ribbon set shaft from the side of the holding means toward the positioning means. Thereupon, the one end portion of the first core is fitted on the positioning means, while the other end thereof elastically engages the holding means. As a result, the first core is held between the first positioning means and the retaining means, and the transfer ribbon with the aforesaid width is set on the ribbon set shaft. In this case, the auxiliary positioning means is not used.

The auxiliary positioning means is used when another transfer ribbon narrower than the aforesaid transfer ribbon is set on the ribbon set shaft. In this case, the auxiliary positioning means is mounted on the ribbon set shaft before the narrower transfer ribbon is set, and is positioned at a predetermined position on the set shaft by means of the engaging portion, which is provided on the set shaft in conformity with the ribbon width. Accordingly, the auxiliary positioning means is situated on the side of the core holding means with respect to the first positioning means so that the distance between the auxiliary positioning mean and the holding means is substantially equal to the width of the narrow transfer ribbon or the length of the second core suited therefor.

In this state, the second core is mounted onto the ribbon set shaft from the side of the core holding means toward the auxiliary positioning means. Thereafter, the one end portion of the second core is supported on the auxiliary positioning means, while another end thereof is caused to engage the holding means. Thus, the second core is held between the auxiliary positioning means and the holding means by means of the elastic force of the retaining means, and the narrow transfer ribbon is set on the ribbon set shaft.

If the ribbon set shaft is provided with a plurality of engaging portions for positioning the auxiliary positioning means with respect to the ribbon set shaft, transfer ribbons of widths conformable to the positions of the engaging portions can be set in the aforementioned manner.

Thus, transfer ribbons with various widths can be set on a common set shaft for printing, and the ribbon unit can be utilized with high efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 19 show a label printer according to an embodiment of the present invention, in which FIG. 1 is a perspective view showing an external appearance of the printer, FIG. 2 is a front view of the printer with its casing off, FIG. 3 is a side view, partially in section, showing the printer with its casing off, FIG. 4 is an exploded perspective view showing the principal mechanism of the printer, FIG. 5 is a front view corresponding to FIG. 2, in which a ribbon unit is off, FIG. 6 is an exploded perspective view showing the ribbon unit and a supporting mechanism, FIG. 7 is a perspective view showing the supporting mechanism in an extended state, along with part of the ribbon unit, FIG. 8 is a sectional view taken along line VIII—VIII of FIG. 6, FIG. 9 is a plan view of the ribbon unit, FIG. 15 is a perspective view of a ribbon set shaft, FIG. 16 is a front view of an auxiliary positioning member, FIG. 17 is a sectional view taken along line XVII—XVII of FIG. 15, FIG. 18 is a plan view showing a state in which a long core is fitted on the ribbon set shaft, and FIG. 19 is a plan view showing a state in which a short core is fitted on the ribbon set shaft;

FIGS. 20 and 21 show a modification of the ribbon set shaft, in which

FIG. 20 is a perspective view, and FIG. 21 is a plan view; and

DETAILED DESCRIPTION OF THE PREFERRED EMBODIMENTS

An embodiment, in which a transfer printer according to an embodiment of the present invention is applied to a label printer, will now be described in detail with reference to the accompanying drawings.

Figure 1:
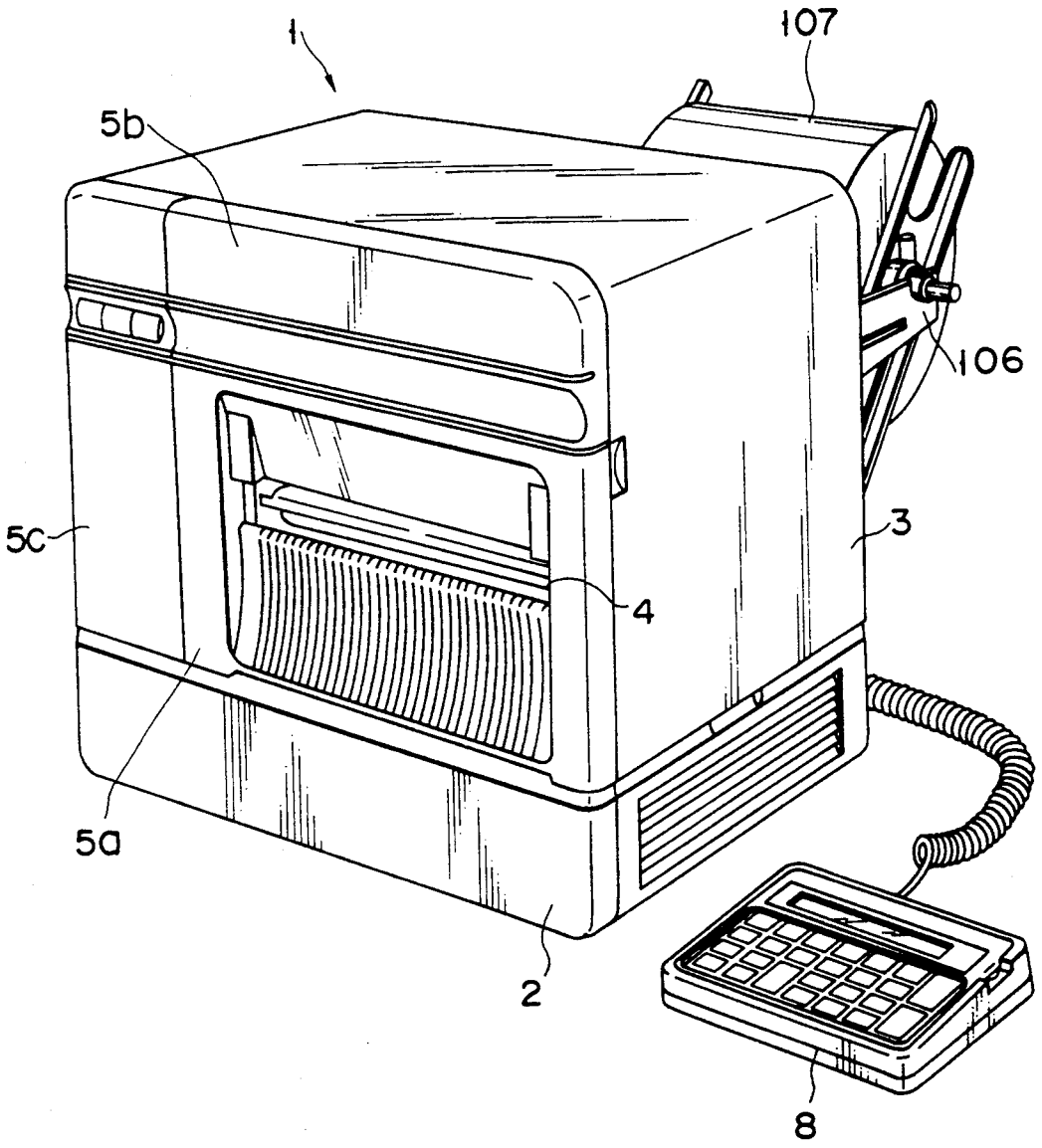
Figure 2:
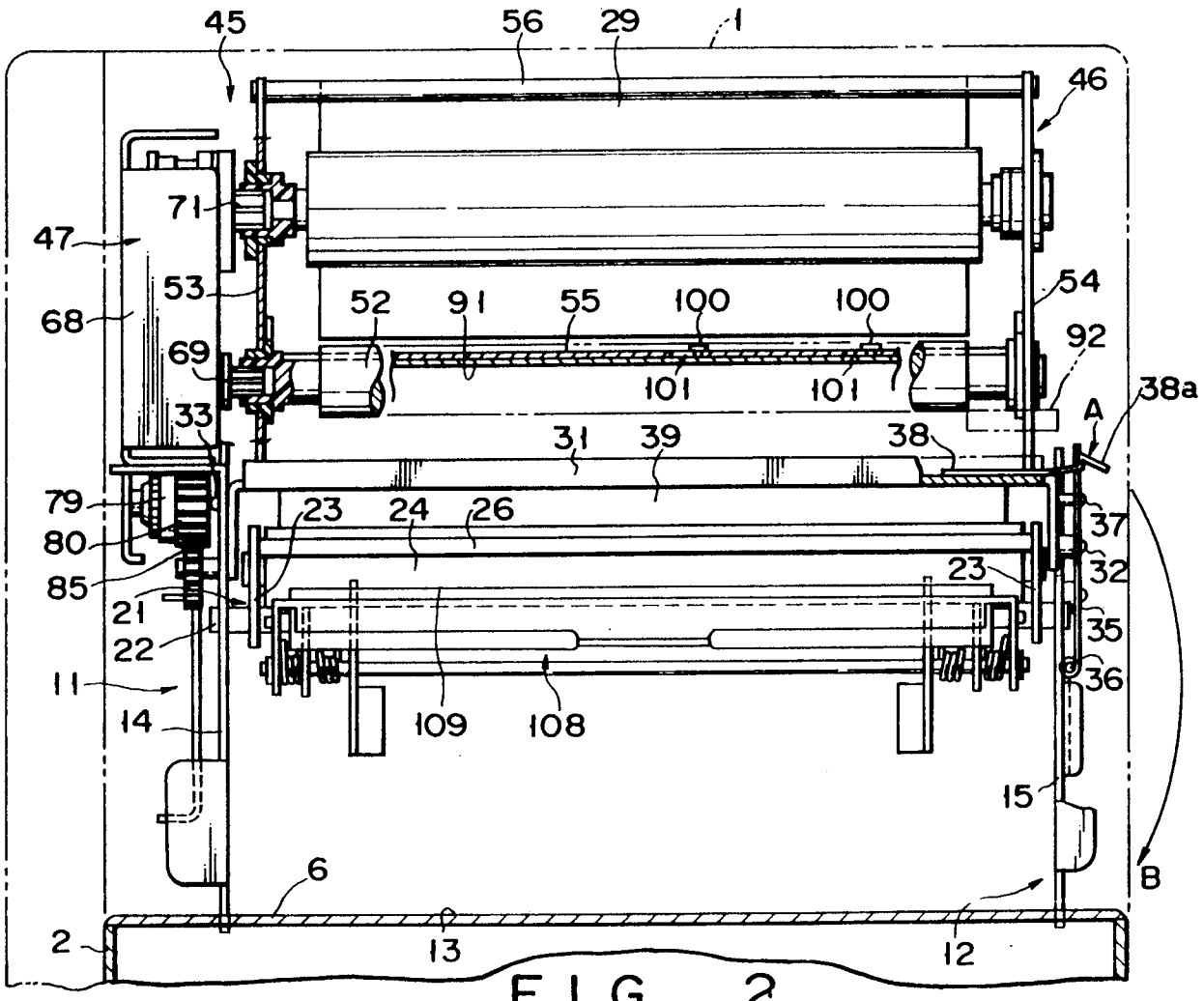
Figure 3:
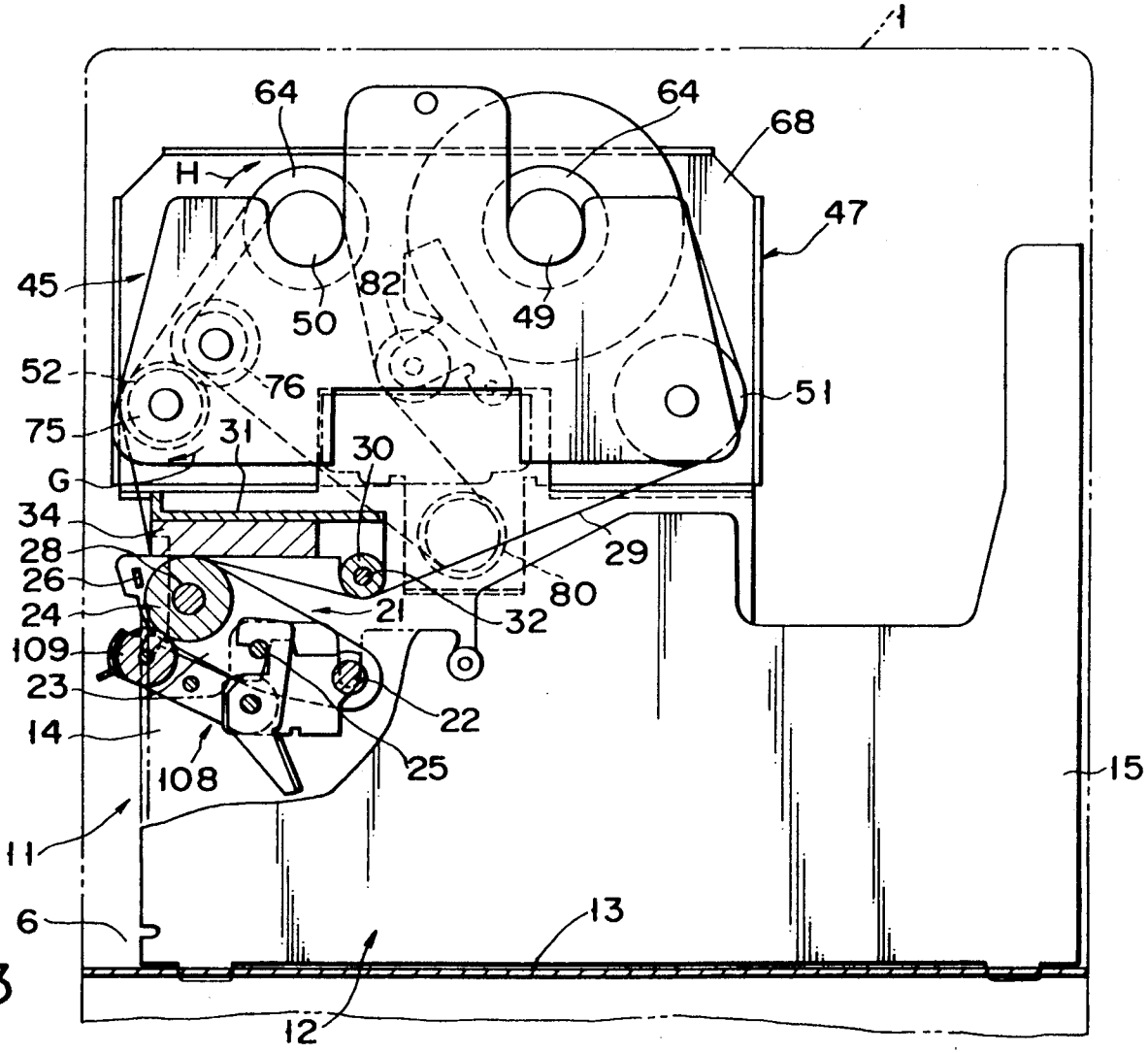

As shown in FIGS. 1 to 3, the label printer has a body casing 1 in the form of a substantially rectangular box. The casing 1 includes a rectangular base 2, a U-shaped side panel 3 having a pair of side walls and a top wall, integral with one another, and removably mounted on the base 2, and an L-shaped first front panel 5*a* removably mounted on the base 2 and having an outlet port 4 through which printed paper is discharged. The casing 1 further includes a second front panel 5*b* formed integrally with the side panel 3 so as to be continuous with the upper portion of the first front panel 5*a*, and a third front panel 5*c* fixed to the base 2 and situated beside and continuous with the first and second front panels. In FIG. 1, reference numeral 8 denotes a controller for entering print information into the printer.

A printing mechanism 11 is disposed in the body casing 1. The following is a description of the mechanism 11.

As shown in FIGS. 2 and 3, the printing mechanism 11 includes a body frame 12 which constitutes a main body of the printer in association with the casing 1. The frame 12 is formed of a horizontal bottom plate 13, fixed to the upper surface of the base 2 of the casing 1, and frame side plates 14 and 15 set up on the left and right end portions of the bottom plate, respectively, these plates being connected to one another. The two side plates 14 and 15 stand upright so as to face each other.

The printing mechanism 11 further includes a platen unit 21, which is located between the frame side plates 14 and 15 and rockably supported by the same. The unit 21 includes a support shaft 22, two end plates 23, a platen roller 24, an intermediate shaft 25, and a torsion spring (not shown).

The support shaft 22 is positioned substantially horizontally between the frame side plates 14 and 15. Both end portions of the shaft 22 are non-rotatably fixed to the side plates 23, respectively. The two end plates 23, which face each other are each in the form of a flat plate, and are arranged adjacent to the side plates 14 and 15, respectively. The respective rear end portions of the end plates 23 are mounted on the support shaft 22 so as to be individually rockable around it.

A bearing (not shown) is mounted on the front end portion of each end plate 23. A platen shaft 28 of the platen roller 24 penetrates these bearings and is supported thereby. Thus, the roller 24 is positioned substantially horizontally between the respective front end portions of the two end plates 23. One end portion of the platen roller 24 is connected to a paper feeding mechanism (not shown) so that the roller 24 is driven in association with the feeding mechanism. The intermediate shaft 25 is positioned between the paired end plates 23 and located between the support shaft 22 and the roller 24. A separating plate 26 extends between the respective front end portions of the end plates 23 and is positioned adjacent to the front portion of the platen roller 24.

The aforesaid torsion spring, which is wound around the support shaft 22, has one end portion anchored to a spring bearing (not shown) fixed to the shaft 22, and the other end portion thereof hooked to the intermediate shaft 25 from under the same. The whole structure of the platen unit 21, except the shaft 22, is urged upward by means of the urging force of the torsion spring. Thus, the platen roller 24 is upwardly pressed against a line thermal head 39, which will be described later. If necessary, e.g., at the time of loading or removal of a ribbon unit 46 (mentioned later), the whole structure of the platen unit 21 except the support shaft 22 is rocked downward around the shaft 22 against the urging force of the torsion spring, by manual operation or automatic control.

A head frame 31 is located above the platen unit 21. It is mounted in the manner shown in FIGS. 2 and 4. More specifically, the rear end portion of the frame 31 is fitted on a supporting shaft 32 which protrudes from the side plate 14 toward the side plate 15. A supporting pin 33 protrudes from the front portion of that end of the head frame 31 which faces the side plate 14. The pin 33 fits in a through hole (not shown) bored in the plate 14. The extreme end portion of the supporting shaft 32 projects from that end wall of the frame 31 on the side of the side plate 15. A supporting pin 34 protrudes from the front end portion of this end wall. The extreme end portion of the shaft 32 and the pin 34 fits in holes 32*a* and 34*a*, respectively, of a clamp plate 35, which is pivotally mounted on the side plate 15.

Figure 4:
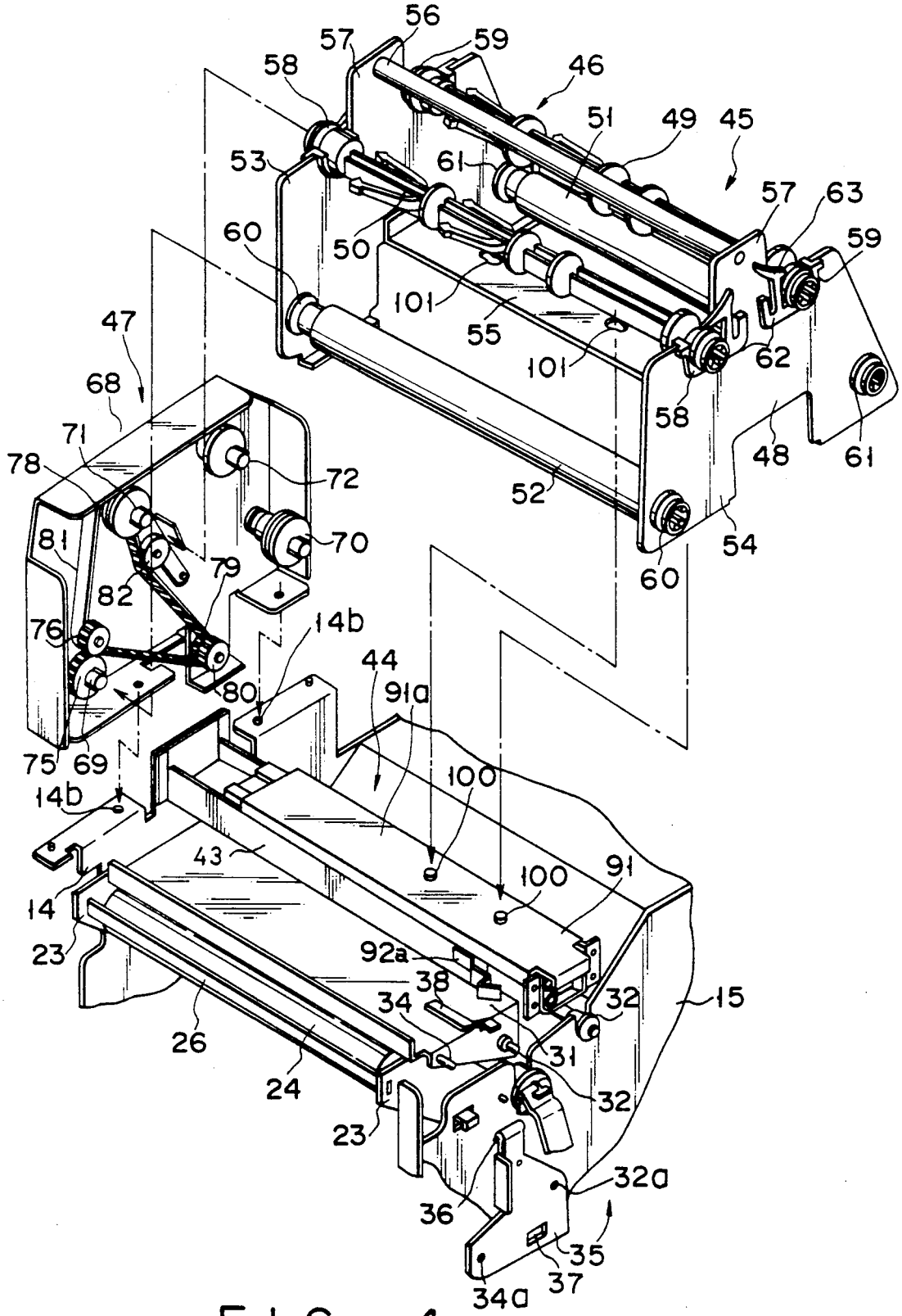
Figure 5:
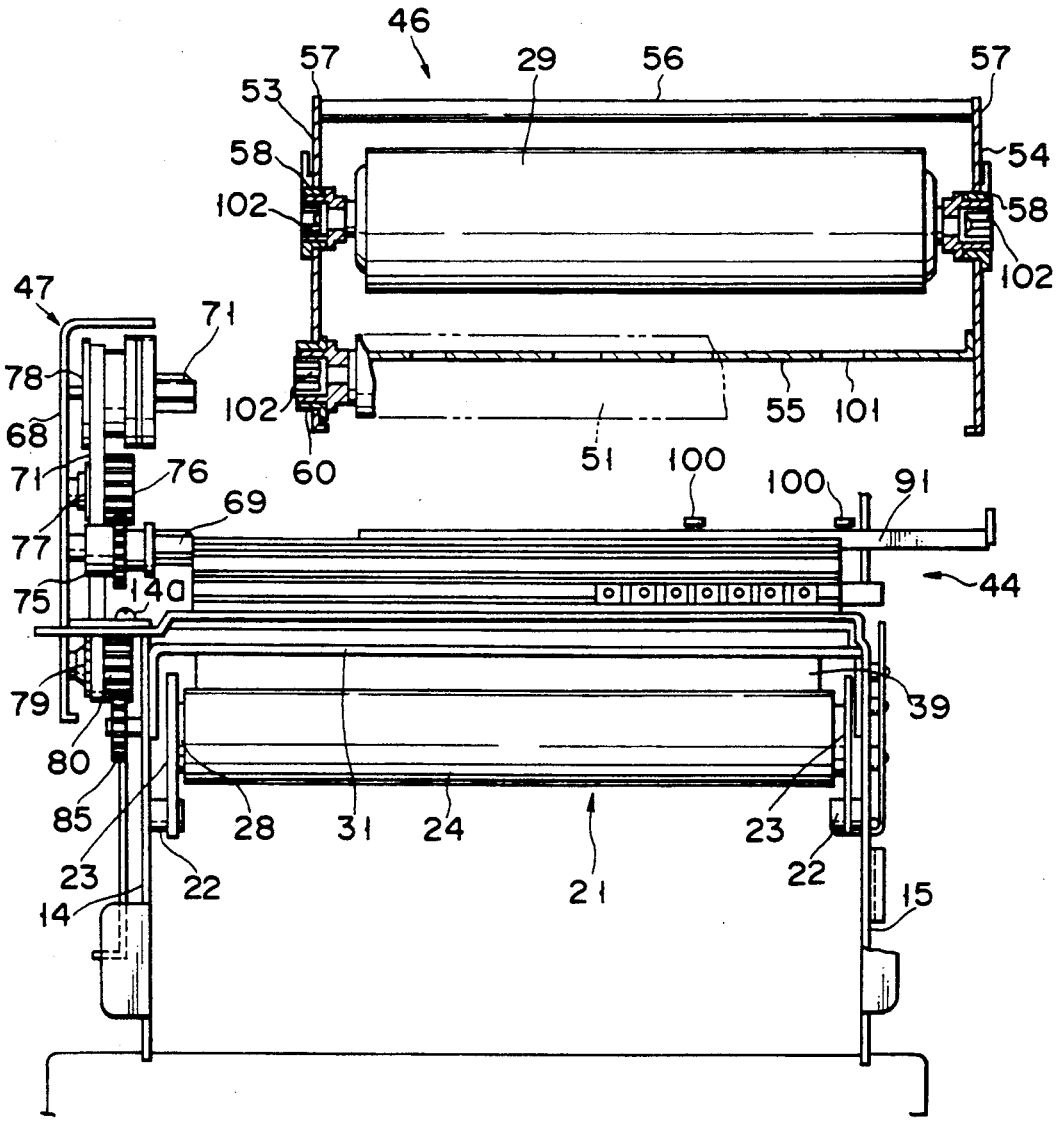
Figure 6:
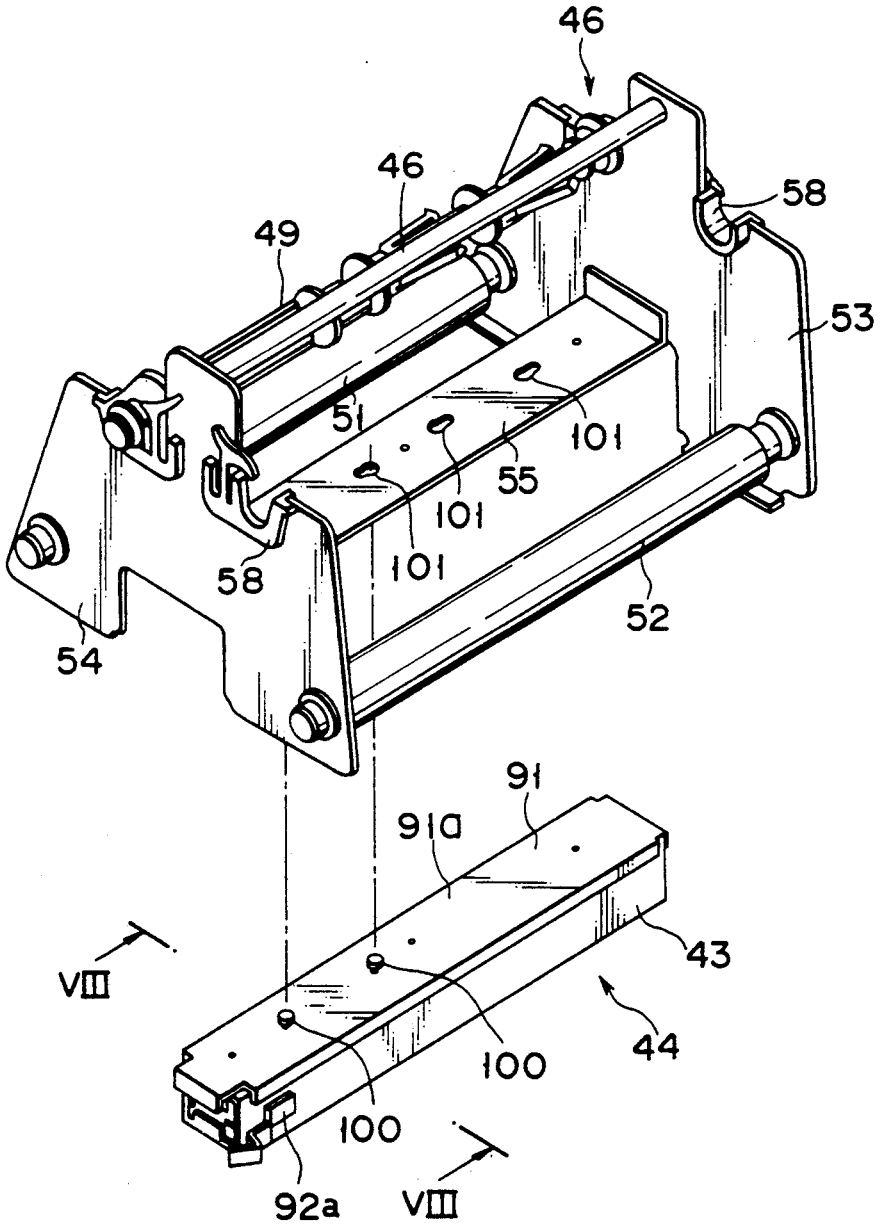

Thus, one end side of the head frame 31 is supported on the side plate 14 by means of the supporting shaft 32 and the supporting pin 33, and the other end side is supported on the clamp plate 35 on the side plate 15 by means of the extreme end portion of the shaft 32 and the supporting pin 34. In FIGS. 2 and 4, numerals 36 and 37 denote a pivot and a retaining hole, respectively, of the clamp plate 35. A leaf spring or retaining plate 38, which is fixed to the upper surface of the head frame 31, is releasably held by the retaining hole 37. As the plate 38 is hooked to the clamp plate 35 in this manner, the head frame 31 is supported. The frame 31 can be released from the support on the side of the side plate 15 by rocking the clamp plate 35 in the direction of arrow B of FIG. 2 after depressing a distal end portion 38*a* of the retaining plate 38 in the direction of arrow A. In this state, the head frame 31 can be drawn out from the body frame 12 to the right.

The line thermal head 39 is fixed to the lower surface of the head frame 31 and extends parallel to the platen roller 24. The roller 24 is pressed against the head 39 from under the same. As shown in FIG. 3, a guide roller 30 for guiding a transfer ribbon 29 is rotatably mounted on the supporting shaft 32 which supports the head frame 31.

Figure 7:
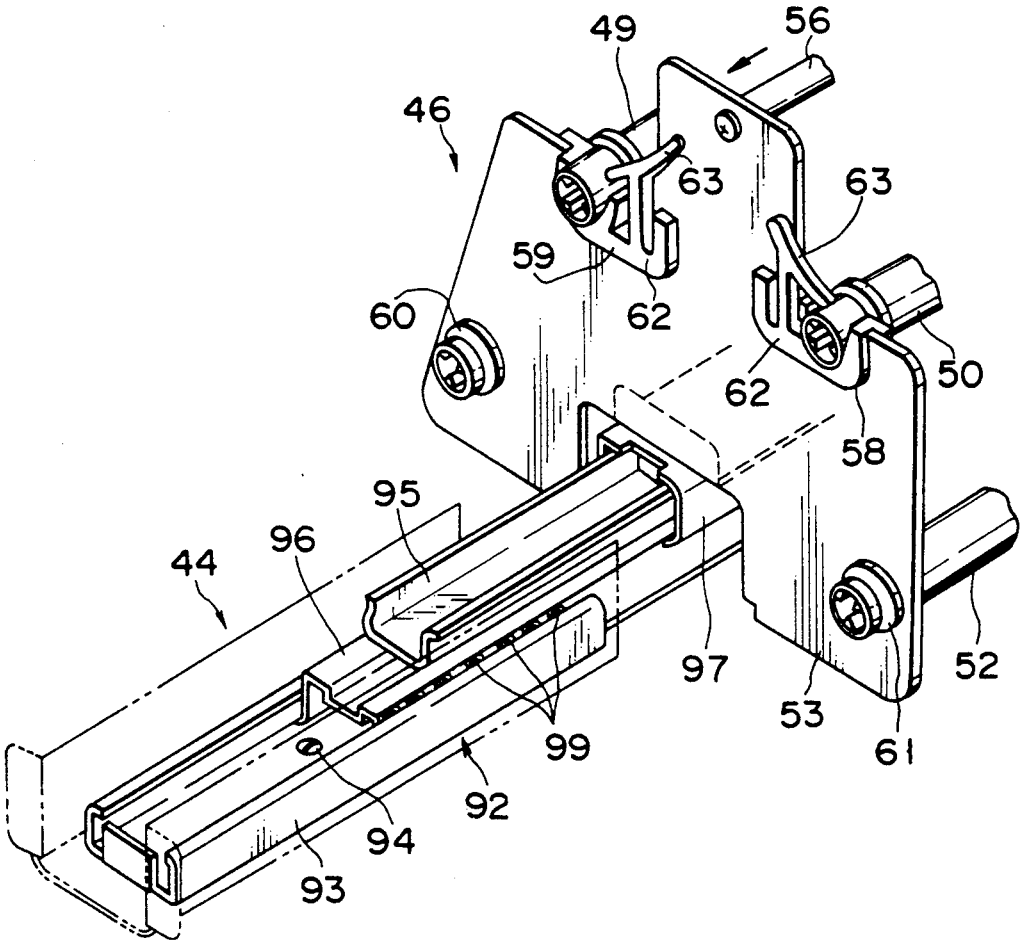
Figure 8:
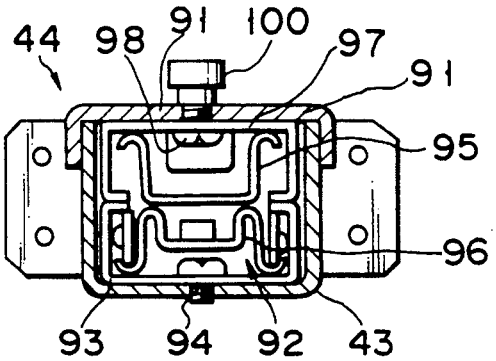

As shown in FIGS. 4, 7 and 8, a ribbon supporting mechanism 44 for supporting the ribbon unit 46 of a ribbon supply device 45 (mentioned later) is arranged above the head frame 31. The supporting mechanism 44 includes a fixed arm 43 which has a U-shaped cross section and extends parallel to the platen roller 24, and an elongated slider 91 mounted on the arm 43 so as to be slidable in the axial direction of the roller 24 by means of a guide mechanism 92. The ribbon unit 46 is removably mounted on the slider 91.

More specifically, one end of the fixed arm 43 is fixed to the frame side plate 14, while the other end extends close to the frame side plate 15. Thus, the arm 43 is supported like a cantilever. A pair of leaf springs or retaining plates 92*a* for elastically fixing the ribbon unit 46 on the slider 91 are fixed individually to the opposite side faces of the distal end portion of the arm 43. The profile of the side plate 15 is lower than that of the side plate 14 so that the region facing the fixed arm 43 on the side of the plate 15 is open. The upper surface of the slider 91 extends parallel to the platen roller 24 or horizontally, and constitutes a supporting surface 91*a* on which the ribbon unit 46 is placed.

The guide mechanism 92 includes a lower rail 93, a pair of intermediate rails 95 and 96, and an upper rail 97. Extending parallel to the fixed arm 43, these rails are substantially as long as the arm 43. The lower rail 93 is fixed to the bottom of the fixed arm 43 by means of a screw 94. The intermediate rail 96 is inserted in the lower rail 93, and a large number of guide rollers 99 are arranged between the rails 93 and 96. Thus, the intermediate rail 96 is axially slidable with respect to the lower rail 93.

The intermediate rail 95 is fixed on the intermediate rail 96, and the upper rail 97 is slidably fitted on the rail 95. The slider 91 is fixed to the upper rail 97 by means of a pair of screws 98. Thus, the slider 91 is slidable between a first position shown in FIG. 4 and a second position. In the second position, the whole body of the slider 91 projects from the casing 1.

A pair of engaging pins 100 are fixed to the upper surface of the slider 91 by means of the screws 98. These pins 100 are situated at a predetermined distance from each other along the axial direction of the slider 91. The upper end portion of each pin 100 is greater in diameter than its lower end portion.

As shown in FIGS. 2 and 3, the ribbon unit 46 of the ribbon supply device 45 is removably straddles on the slider 91 of the supporting mechanism 44.

As shown in FIGS. 2 to 7, and 9, the ribbon unit 46 includes a ribbon supporting frame 48, a pair of ribbon set shafts 49 and 50, a tension shaft 51, and a ribbon drive shaft 52.

In the ribbon supporting frame 48, the respective bottom portions of a pair of opposite side plates 53 and 54 are connected to each other by means of a lower cross member 55, and lugs 57 protruding individually from the center of the respective top portions of the side plates 53 and 54 are connected to each other by means of an upper cross member 56. The upper cross member 56, which is formed of a round rod, serves as a carrying handle for the ribbon unit 46.

The lower cross member 55 is formed to have two pairs of 8-shaped holes 101. The engaging pins 100 of the slider 91 individually engage one pair of holes 101, whereby the ribbon unit 46 is retained on the slider 91. The two pairs of holes 101 are arranged symmetrically with respect to the center of the lower cross member 55 as viewed in the longitudinal direction.

A pair of first upper bearings 58 are individually mounted to face each other on the respective upper portions of the side plates 53 and 54 and are situated in front of their corresponding lugs 57. Also, a pair of second upper bearings 59 are mounted to face each other at the back of the lugs 57. A pair of bearings 60 are individually mounted to face each other on the respective lower front portions of the side plates 53 and 54, while a pair of bearings 61 are mounted to face each other on the respective lower rear portions of the plates 53 and 54.

The bearings 58 and 59, which are formed of synthetic resin, each include an open-topped U-shaped bearing portion 62 and a hook portion 63 situated in close proximity to the top of the portion 62. The proximal part of the hook portion 63 is thin to enable elastic deformation. As this proximal part is elastically deformed, the hook portion 63 can move close to or away from the open top of the bearing portion 62.

Two opposite axial end portions 49*a* of the ribbon set shaft 49 are rotatably supported individually by means of the second upper bearings 59 on the rear side of the ribbon supporting frame 48 so that the shaft 49 extends transversely between the two side plates 53 and 54. The shaft 49 is removably mounted on the bearings 59. More specifically, the hook portions 63 are pressed against the respective upper peripheral surfaces of their corresponding shaft end portions 49*a* of the set shaft 49, which are supported by means of the bearings 59. Thus, the set shaft 49 is prevented from being unexpectedly disengaged upward from the upper bearings 59. The ribbon set shaft 49 can be removed from the frame 48 by manually pulling in an upward direction. If the shaft 49 is drawn upward, the hook portions 63 undergo elastic deformation, so that the shaft end portions 49*a* are disengaged upward from their corresponding bearing portions 59. Thus, the ribbon set shaft 49 can be removed.

Shaft end portions 50*a* on the opposite sides of the ribbon set shaft 50 are rotatably supported individually by means of the first upper bearings 58 on the front side of the ribbon supporting frame 48 so that the shaft 50 extends transversely between the two side plates 53 and 54. The shaft 50 is removably mounted on the bearings 58. Since this set shaft 50 is attached and detached in the same manner as the set shaft 49, a description of the procedure of operation for the attachment and detachment is omitted.

The ribbon set shafts 49 and 50 are identical in size and shaped to each other. Thus, these shafts 49 and 50 can be mounted on the two pairs of bearings 58 and 59 on the ribbon supporting frame 48 while being replaced with each other in the aforementioned operation.

The ribbon set shafts 49 and 50 and the two pairs of bearings 58 and 59, front and rear, are located symmetrically with respect to an imaginary plane H (see FIG. 9) which passes through the center of the ribbon unit 46, as viewed in the depth direction, or extends parallel between the shafts 49 and 50.

Each of the ribbon set shafts 49 and 50 is removably fitted with cylindrical cores 64 on which a transfer ribbon 29 (mentioned later) is wound. The ribbon 29 is wound around the core 64 supported on the ribbon set shaft 49 which serves as a supply shaft. After being drawn out from the shaft 49 and transported successively past the tension shaft 51 and the ribbon drive shaft 52, the ribbon 29 is reeled onto the core 64 supported on the ribbon set shaft 50 which serves as a take-up shaft. That portion of the transfer ribbon 29 which extends between the tension shaft 51 and the ribbon drive shaft 52 passes between the platen roller 24 and the line thermal head 39 which constitute a printing section.

Shaft end portions 52*a* on the opposite sides of the ribbon drive shaft 52 are rotatably supported individually by means of the bearings 60 so that the shaft 52 extends transversely between the two side plates 53 and 54. Thus, the shaft 52 is situated between the printing section and the ribbon set shaft 50, on the front side of the head frame 31. The transfer ribbon 29 moving from the printing section toward the set shaft 50 is wound around the outer circumferential surface of the ribbon drive shaft 52. That portion of the circumferential surface of the shaft 52 which is in contact with the ribbon 29 is formed of a material, e.g., rubber, which ensures a great force of friction with the ribbon 29.

Shaft end portions 51*a* on the opposite sides of the tension shaft 51 are rotatably supported individually by means of the bearings 61 so that the shaft 51 extends transversely between the two side plates 53 and 54. Thus, the shaft 51 is situated between the printing section and the ribbon set shaft 49, on the rear side of the head frame 31. The transfer ribbon 29 moving from the set shaft 49 toward the printing section is wound around the outer peripheral surface of the tension shaft 51. The circumferential surface of the shaft 51, which is in contact with the ribbon 29, is also formed of rubber or other high-friction material.

The tension shaft 51 has the same size and shape as the ribbon drive shaft 52. The shafts 51 and 52 and the two pairs of bearings 60 and 61, front and rear, are located symmetrically with respect to the aforesaid imaginary plane H. Thus, the four rotatable shafts 49, 50, 51 and 52 on the ribbon supporting frame 48 are arranged symmetrically with respect to the center P (extending at right angles to the shafts 49 to 52, on the imaginary plane H of FIG. 9) of the ribbon unit 46.

Figure 10A:
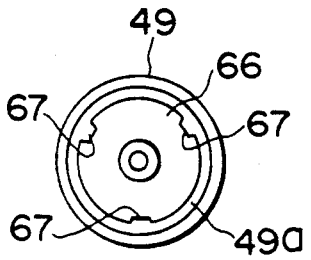
FIG. 10A is a front view of a shaft end portion.
Figure 10B:
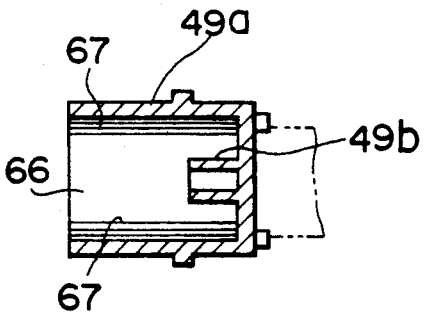
FIG. 10B is a sectional view of the shaft end portion.
Figure 11A:
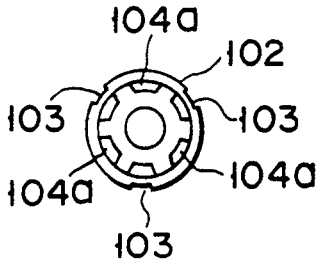
FIG. 11A is a front view of a relay core.
Figure 11B:
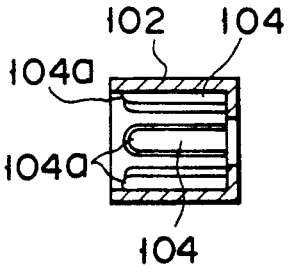
FIG. 11B is a sectional view of the relay core.
Figure 12A:
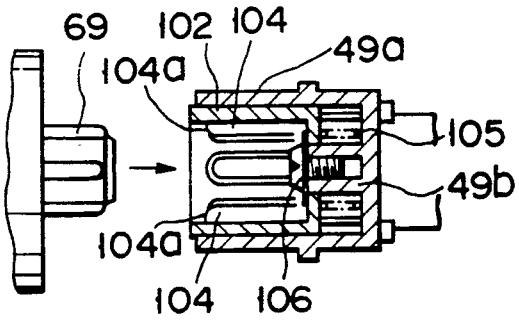
FIGS. 12A to 12C are sectional views individually showing processes of operation for connecting the shaft end portion and a drive shaft end portion.

Each of the shaft end portions 49*a*, 50*a*, 51*a* and 52*a* is formed have a connecting hole 66. With respect to one of the shaft end portions 49*a*, by way of example, three projections 67 are arranged at regular intervals on the inner circumferential surface of the connecting hole 66 so as to extend in the axial direction, as shown in FIGS. 10A and 10B. A cylindrical boss 49*b* protrudes from the bottom of the hole 66. As shown in FIG. 12A, a cylindrical relay core 102 is axially slidably inserted in the connecting hole 66. As shown in FIG. 11A, three axial grooves 103 are formed on the outer circumferential surface of the core 102 and the projections 67 of each shaft end portion 49*a* fit individually in the grooves 103. As shown in FIGS. 11A and 11B, six axial projections 104 protrude from the inner circumferential surface of the core 102. A through hole is bored through the bottom wall of the core 102, and the boss 49*b* is passed through the through hole.

Further, a coil spring 105 for use as an urging member is provided between the bottom of the connecting hole 66 and the relay core 102. The spring 105 urges the core 102 to project from the hole 66. Thus pressed by the spring 105, the core 102 abuts against a stopper 106 which is screwed to the boss 49*b*.

Each projection 104 of the relay core 102, constructed in this manner, has a tapered tip end portion 104*a*.

Referring now to FIGS. 2 to 5, a ribbon drive section 47 will be described. This drive section 47 includes a rectangular base 68 whose side edge portions are bent at right angles. A horizontal plate portion of the base 68 on the lower side is fixed to the upper surface of the end portion of the frame side plate 14 by means of screws 14*a*. Four rotating shafts 69, 70, 71 and 72 protrude horizontally from a vertical plate portion of the base 68. The shafts 69, 70, 71 and 72 are arranged to correspond in position to the shafts 52, 51, 50 and 49, respectively, of the ribbon unit 46.

A gear 75 is mounted coaxially on the rotating shaft 69 at the lower front portion of the base 68, and a gear 76 is in mesh with the gear 75. A toothed pulley 77 is mounted coaxially on the gear 76. A pulley 78 is integrally provided on the rotating shaft 71 at the upper front portion of the base 68, and a toothed pulley 79 and a driving gear 80 are arranged coaxially in the center of the lower portion of the base 68. A timing belt 81 is passed around and between the pulleys 77, 78 and 79. A tension roller 82 is pressed against the belt 81, thereby applying a tension to the belt 81.

The driving gear 80 is in mesh with a gear 85 of a drive system for the platen roller 24. Thus, the ribbon drive section 47 is driven in synchronism with the roller 24.

Figure 10C:
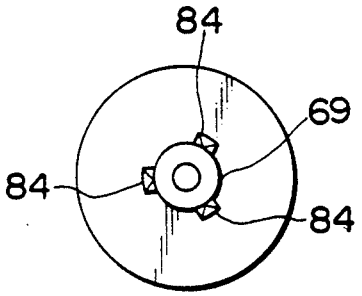
FIG. 10C is a front view of a rotating shaft end portion.
Figure 10D:
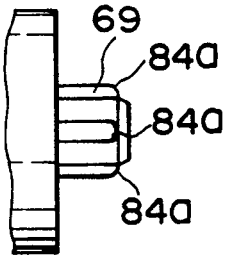
FIG. 10D is a side view of the rotating shaft end portion.
Figure 9:
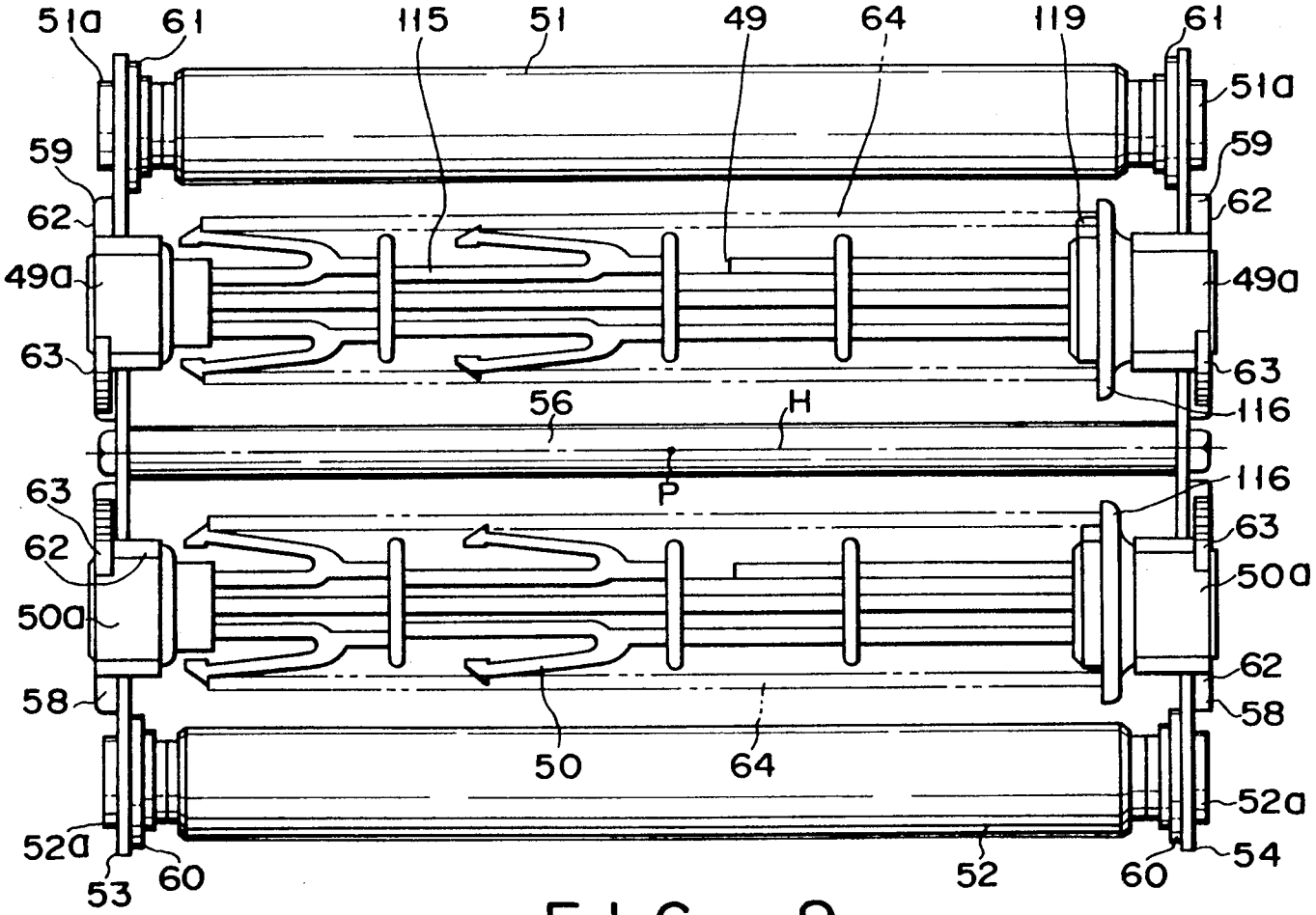

As shown in FIGS. 10C and 10D, each of the rotating shafts 69, 70, 71 and 72 has three axial projections 84 on its outer circumferential surface. When the rotating shafts 69, 70, 71 and 72 are inserted into the connecting holes 66 of the corresponding relay cores 102, the projections 84 of each shaft are caught between the projections 104 of the relay core 102 in the connecting hole 66, thereby enabling power transmission. The tip end portion of each projection 84 is also tapered.

In the thermal printer with this construction, the transfer ribbon 29 is set in the following manner, with the side panel 3 (see FIG. 1) off the body casing 1.

First, the platen roller 24 is moved downward to be separated from the thermal head 39 by the use of drive means (not shown), and the clamp plate 35 is rotated in the direction of arrow B (in FIG. 2) to release the lock of the head frame 31. The slider 91 of the ribbon supporting mechanism 44 is then pulled. Thereupon, the upper rail 97 and the intermediate rails 95 and 96 are slidingly drawn out, and the slider 91 is drawn out from the casing 1.

Figure 13A:
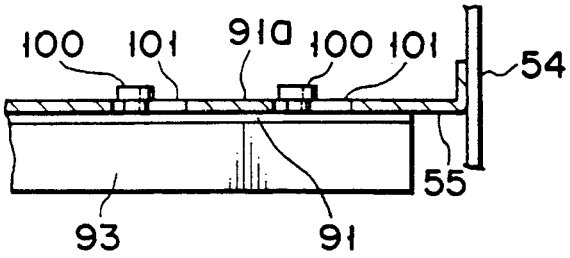
FIGS. 13A and 13B are schematic views showing different states of connection between the ribbon unit and a slider.
Figure 13B:
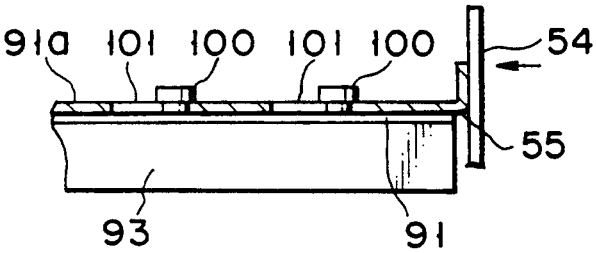
Figure 14A:
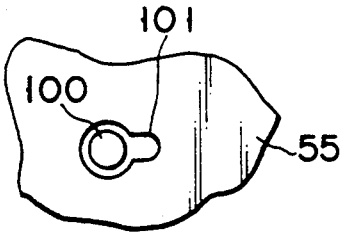
FIGS. 14A and 14B are schematic plan views individually showing different states of engagement between an engaging pin and an engaging hole.
Figure 14B:
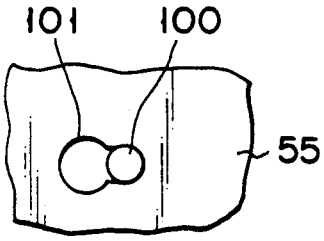

Subsequently, the transfer ribbon 29 is set on the ribbon supporting frame 48, and that portion of the ribbon situated between the tension shaft 51 and the ribbon drive shaft 52 is drawn downward to form a small sag. In this state, the drawn-out portion of the ribbon 29 is passed through the slider 91, and the ribbon unit 46 is then mounted on the slider 91. In mounting this unit 46, the lower cross member 55 is first placed on the slider 91 in a manner such that the engaging pins 100 of the slider are inserted individually in the respective large-diameter portions of their corresponding 8-shaped holes 101 of the cross member 55, as shown in FIGS. 13A and 14A. Thereafter, the ribbon unit 46 is moved in the direction of the arrow of FIG. 13B toward the casing 1. Thereupon, the head portion of each pin 100 engages the small-diameter portion of its corresponding hole 101, as shown in FIG. 14B, so that the ribbon unit 46 is retained on the slider 91.

After being held in position in this manner, the ribbon unit 46, along with the slider 91, is pushed into the body casing 1 of the printer. As a result, the slider 91 is moved to the first position, and the ribbon unit 46 is housed in the body casing 1. The relay cores 102 in the respective connecting holes 66 of the shafts 49, 50, 51 and 52 of the unit 46 are fitted on the rotating shafts 72, 71, 70 and 69, respectively, of the ribbon drive section 47, which is fixed on the side plate 14. Thus, the drive section 47 and the ribbon unit 46 are connected to each other. At this time, the retaining plates 92*a* attached to the fixed arm 43 are pressed by the side plate 54 of the ribbon supporting frame 48, so that they are temporarily deformed against their elastic force. When the side plate 54 clears the plates 92*a*, thereafter, the plates 92*a* are restored to engage the plate 54, thereby fixing the ribbon unit 46, as shown in FIG. 2. Thus, the ribbon supply device 45 is assembled.

In connecting the ribbon unit 46 to the drive section 47, the respective tip end portions 104*a* of the projections 104 of the relay cores 102 and extreme end portions 84*a* of the projections 84 of the rotating shafts 69, 70, 71 and 72 sometimes run against one another.

Figure 12B:
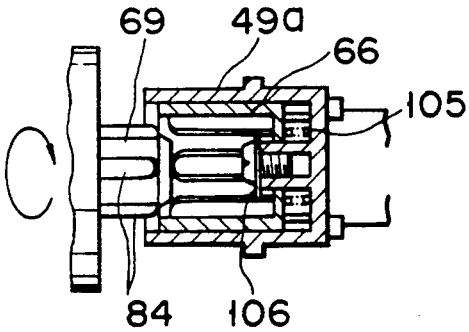
Figure 12C:
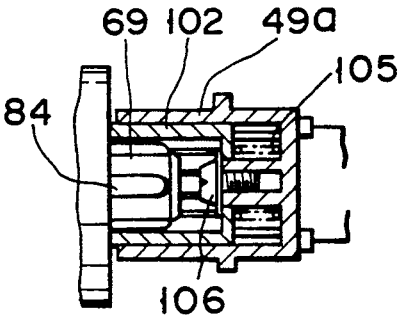

In such a case, each relay core 102 retreats against the urging force of the coil spring 105, as shown in FIG. 12B, and the rotating shaft 69 (70, 71 or 72) rotates in the direction of the arrow of FIG. 12B so that the respective tapered end portions 84*a* of the projections 84 slide along their corresponding tapered end portions 104*a* of the projections 104 of the core 102 to be disengaged therefrom. At this time, the core 102 is pushed out by means of the urging force of the spring 105, so that its projections 104 are fitted into the spaces between the projections 84 of the rotating shaft.

Thus, the ribbon drive section 47 and the ribbon unit 46 are connected to each other, that is, the ribbon supply device 45 is assembled.

The sagging portion of the transfer ribbon 29 is passed between the platen roller 24 and the line thermal head 39 which are separated from each other. In this state, the surplus portion of the ribbon 29 is taken up by manually turning the take-up reel 50. Then, paper pasted with a large number of labels is drawn out from a paper roll 107, which is set on a paper holder 106 (see FIG. 1) attached to the rear face of the body casing 1, and is introduced into the casing 1 through the rear face thereof. This paper is passed between the roller 24 and the head 39 separated from each other, in a region under the transfer ribbon 29. Thereafter, the platen roller 24 is rocked upward to come into contact with the thermal head 39.

That portion of the transfer ribbon 29, set in this manner, which extends from the supply shaft 49 to the take-up shaft 50 is transported past the printing section. When the line thermal head 39 is actuated, therefore, ink of the ribbon 29 is transferred to the labels on the paper, thus effecting printing.

In FIGS. 2 and 3, numeral 108 denotes a separating mechanism for separating the printed labels from the paper in cooperation with the separating plate 26. The mechanism 108 includes a separating roller 109 which is pressed against the platen roller 24 from under the same. Those portions of the paper passed the separating plate 26 from which the labels are separated are held between the roller 109 and the platen roller 24. By rotating the separating roller 109 following the platen roller 24 to apply a tensile force to the paper, the printed labels are securely separated from the paper at the location of the separating plate 26.

Referring now to FIGS. 9 and 15 to 19, an arrangement for mounting the core 64 to be wound with the transfer ribbon 29 on the ribbon set shaft 49 or 50 will be described. Since the shafts 49 and 50 are identical in structure and shape, only the shaft 49 will be explained for simplicity.

The shaft 49 has a shaft body 115 formed of synthetic resin, and is provided at one end portion thereof with a core positioning portion 116 for preventing the core 64 from moving radially and axially. The positioning portion 116 includes a disk-shaped flange 117 having the shaft end portion 49*a* protruding from one side surface thereof, a circular core support 118 protruding integrally from the other side surface of the flange 117, and a projection 119 protruding integrally from part of the circumferential surface of the support 118.

The diameter of the core support 118 is greater than that of the shaft body 115 and smaller than that of the flange 117. The diameter of the support 118 is a little smaller than the inner diameter of the core 64, and the support 118 is fitted in one end portion of the core 64. The projection 119 is fitted in a notch (not shown) at the end portion of the core 64, so that the core 64 is prevented from rotating relative to the ribbon set shaft 49.

First and second core holding portions 121 and 122 are individually arranged on the other end side of the shaft body 115. The holding portions 121 and 122, which have the same structure, each includes a pair of arms 123 disposed on either side of the shaft body 115. Each arm 123, which is elastically deformable, spreads radially outward, gradually receding from the shaft body 115 with distance from the one end portion thereof. A hook portion 124 for engaging the other end of the core 64 is formed at the distal end of each arm 123.

The shaft body 115 is formed having an engaging portion 125 situated between the core positioning portion 116 and the second core holding portion 122. The engaging portion 125 is in the form of a circular flange whose diameter is greater than that of the shaft body 115. In the present embodiment, the portion 125 doubles as a core support, having the same diameter as the core support 118.

Further, the shaft body 115 is formed having a core support 126, situated between the first and second core holding portions 121 and 122, and a core support 127 situated between the second core holding portion 122 and the engaging portion 125. These core supports 126 and 127 are each in the form of a circular flange having the same diameter as the core support 118.

As seen from FIGS. 15 to 18, a shaft portion 115*a* of the shaft body 115 situated between the engaging portion 125 and the core support 127 is in the form of a cross having a bar on the top, and part of its top portion 128 is notched. Numeral 129 denotes the notch.

Figure 15:
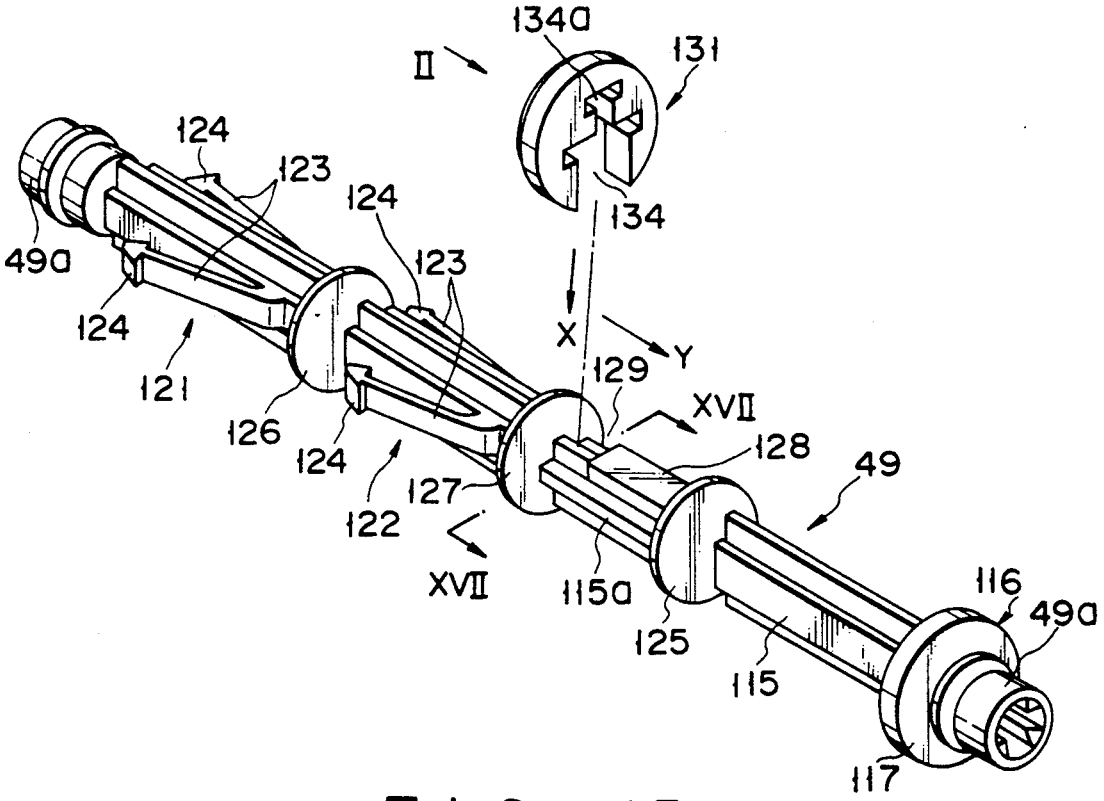
Figure 16:
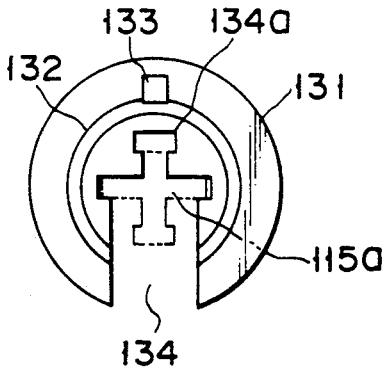
Figure 17:
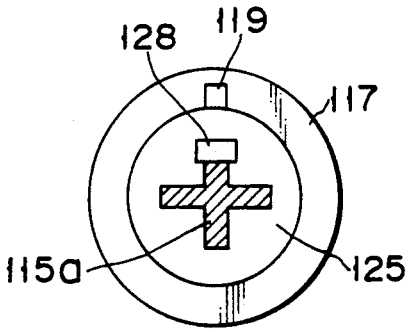

In FIG. 15, numeral 131 denotes an auxiliary positioning member which is designed to be removably mounted on the ribbon set shaft 49. The positioning member 131 is mounted on the shaft 49 when a narrow transfer ribbon is set on the shaft 49. The member 131 is a disk-shaped piece having the same diameter as the flange 117. As shown in FIG. 16, a core support 132 and a projection 133 are formed integrally on one side of the member 131. The support 132 and the projection 133 are arranged in the same relation as the core support 118 and the projection 119 of the core positioning portion 116. Also, the auxiliary positioning member 131 is formed having a fitting recess 134 in which the shaft portion 115*a* is fitted.

The ribbon set shaft 49, constructed in this manner, is alternatively fitted with the core 64 for the transfer ribbon 29 of 4-inch width or a core 64' for a transfer ribbon 29' of 2-inch width, for example.

Figure 18:
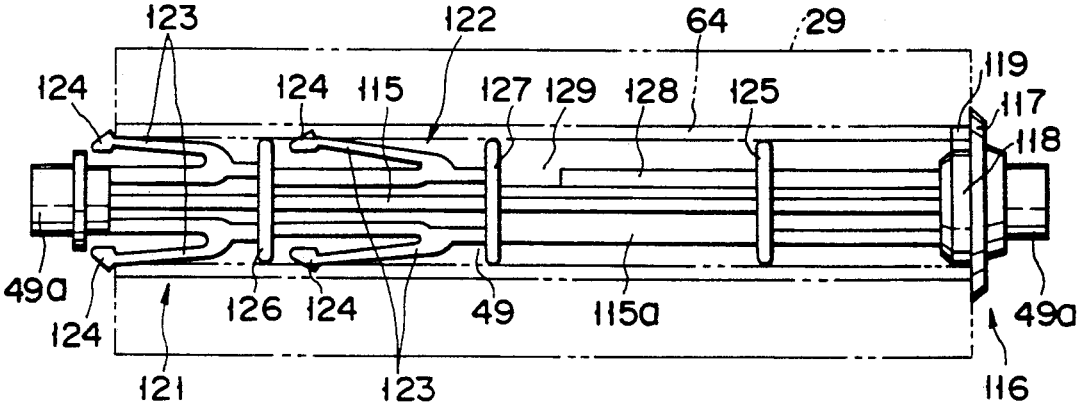

The following is a description of the way of mounting the core 64 of 4-inch length. The auxiliary positioning member 131 is not used in this case. First, the core 64 is fitted onto the ribbon set shaft 49 in a manner such that the respective arms 123 of the first and second core holding portions 121 and 122 are elastically deformed to be brought closer to the shaft body 115 so that they are housed in the core 64. The fitting of the core 64 on the shaft 49 is further advanced so that the one end portion of the core 64 abuts against the inner surface of the flange 117 of the positioning portion 116 and is fitted on the core support 118. At the same time, the notch groove (not shown) at the end portion of the core 64 is caused to engage the projection 119. Thereupon, the one end portion of the core 64 is supported by the core positioning portion 116, as shown in FIG. 18, so that the core 64 is prevented from rotating in the circumferential direction with respect to the ribbon set shaft 49, and from moving toward the flange 117 and in the radial direction. The moment the one end side of the core 64 is supported in this manner, the hook portions 124 of the arms 123 which constitute the first core holding portion 121 project from the other end of the core 64, and the arms 123 spread out by means of their elastic force. As a result, the hook portions 124 elastically engage the other end of the core 64. Thus, the other end of the core 64 is supported by the first core holding portion 121, and the holding portion 121 prevents the core 64 from slipping off.

Thus, the core 64 is held between the core positioning portion 116 and the first core retaining portion 121, and is mounted on the central portion of the ribbon set shaft 49, as shown in FIG. 18. In this state, the intermediate portion of the core 64 is supported by means of the core supports 126 and 127 and the engaging portion 125 from the inside.

The core 64, mounted in this manner, can be removed by first elastically deforming the pair of arms 123 which constitute the first core retaining portion 121 toward the shaft body 115 by fingers, thereby disengaging the hook portions 124 from the other end of the core 64, and then drawing out the core 64 to the left of FIG. 18.

The following is a description of the way of mounting the core 64' of 2-inch length. The auxiliary positioning member 131 is used in this case.

Figure 19:
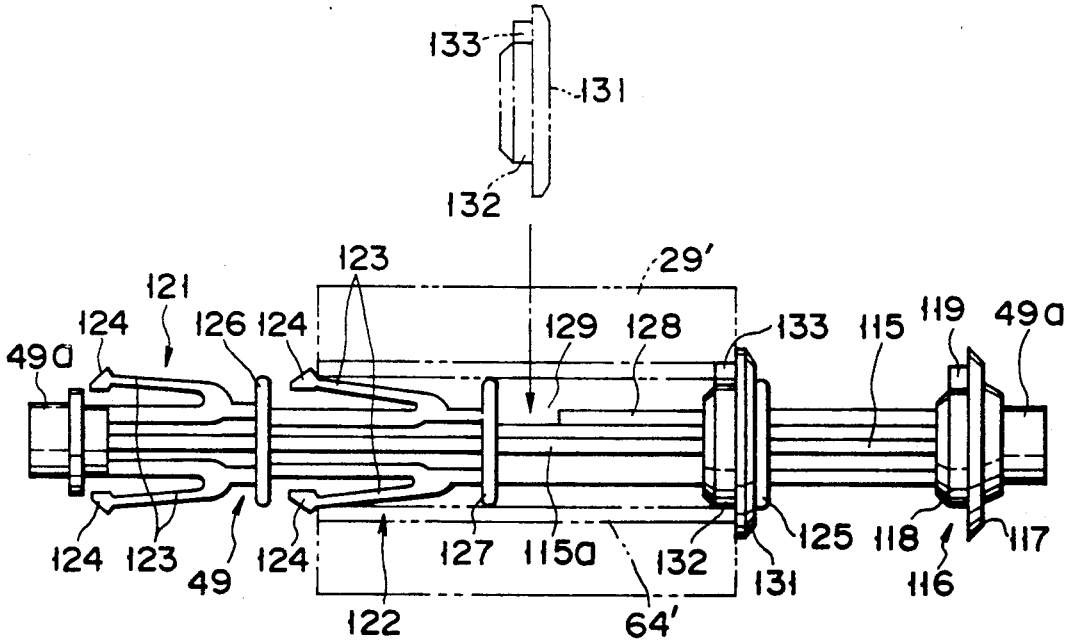

The positioning member 131 is mounted, as shown in FIG. 19, by causing the fitting recess 134 to engage the notch 129 of the ribbon set shaft 49 in the direction of arrow X of FIG. 15, and then moving the member 131 in the direction of arrow Y so that it abuts against the engaging portion 125. In this mounted state, a T-shaped top slit portion **134*a* of the fitting recess 134*a* of the member 131, as shown in FIGS. 15 and 16, engages a T-shaped portion of the shaft portion 115*a* which is formed of the top portion 128 and a vertical portion continuous therewith. Thus, the positioning member 131 cannot be unexpectedly disengaged from the set shaft 49** in a direction perpendicular to the axial direction.

Thereafter, the core 64' of 2-inch length is mounted on the set shaft 49 in the same manner as the above-described core 64 of 4-inch length. More specifically, the core 64' is fitted onto the shaft 49 from the side of the first core holding portion 121 toward the core positioning portion 116. Thereupon, one end portion of the core 64' abuts against the auxiliary positioning member 131, and is fitted on the core support 132. Also, a notch groove (not shown) at the end portion of the core 64' is caused to engage the projection 133. At the same time, the hook portions 124 of the arms 123 which constitute the second core holding portion 122 project from the other end of core 64', and the arms 123 spread out by means of their elastic force. As a result, the hook portions 124 elastically engage the other end of the core 64'.

Thus, the core 64' is held between the auxiliary positioning member 131 and the second core holding portion 122, and is mounted on the central portion of ribbon set shaft 49, as shown in FIG. 19. In this state, the intermediate portion of the core 64' is supported by means of the core support 127 from the inside.

Since the core 64' can be removed from the ribbon set shaft 49 in the same manner as in the case of the longer core 64, a description of the procedure for the removal is omitted.

Thus, the longer core 64 and the shorter core 64' can be optionally replaced with each other, depending on the need of use of the auxiliary positioning member 131, and the ribbon set shaft 49 can be used in common for the cores 64 and 64'.

The following is a description of the operation of the ribbon supply device 45 during use of the label printer constructed in this manner. When the platen roller 24 is rotated in association with the operation of the paper feeding mechanism (not shown), the gear 80 of the ribbon drive section 47 is rotated by means of the gear 85. As a result, the timing belt 81 is driven by means of the toothed pulley 79, and the rotating shaft 69 is rotated by means of the gears 76 and 75. Also, the rotating shaft 71 is rotated by means of the toothed pulley 78.

Since the rotating shaft 69 is connected with the ribbon drive shaft 52 of the ribbon unit 46, it rotates in the direction of arrow G of FIG. 3, thereby running the transfer ribbon 29 in contact with the outer circumferential surface thereof. At this time, the take-up shaft 50 is connected to the rotating shaft 71, so that it rotates in the direction of arrow H of FIG. 3, thereby taking up the ribbon 29 transported past the shaft 52.

At this time, moreover, the supply shaft 49 and the tension shaft 51 are driven to rotate by means of the take-up force of the transfer ribbon 29, so that the ribbon 29 is supplied, and a tension is applied to the ribbon 29 by means of the tension shaft 51. In synchronism with the travel of the ribbon 29, the paper also runs in a predetermined direction, and desired information is printed on the labels on the paper by means of the thermal head 39.

When the transfer ribbon 29 is entirely taken up after continued printing, it should be changed.

In this case, the side panel 3 of the body casing 1 is first removed, and the platen roller 24 is then moved downward to be separated from the thermal head 39 by the use of drive means (not shown). Thereafter the ribbon unit 46 is pulled. As a result, the retaining plates **92*a* are elastically deformed to be disengaged from the side pate 54 of the ribbon supporting frame 48, so that the fixation is removed. Further, the shafts 49 to 52 of the ribbon unit 46 are disengaged from the rotating shafts 69 to 72 of the drive section 47. If the ribbon unit 46 is pulled, moreover, the slider 91, the upper rail 97, and the intermediate rails 95 and 96 are slidingly drawn out, and the unit 46 is drawn out from the body casing 1**.

In this state, the respective proximal parts of the hook portions 63 of the bearings 58 and 59 of the ribbon unit 46 are elastically deformed to disengage the supply shaft 49 and the take-up shaft 50, and these shafts 49 and 50 are removed from the bearings 58 and 19, respectively. Then, the shafts 49 and 50 wound with a new transfer ribbon 29 are mounted on the bearings 59 and 58, respectively, of the unit 46.

Thereafter, the ribbon unit 46 is inserted into the body casing 1 to be set therein in the same manner as aforesaid, whereupon the replacement is finished.

Reuse of the transfer ribbon 29 having ink remaining thereon can be facilitated in the following manner. The ribbon unit 46 is removed from the slider 91 by holding up the handle 56 after it is drawn out from the body casing 1. After the unit 46, which has a symmetrical configuration, is turned 180 degrees around the axis P on the imaginary plane H, it i mounted on the slider 91. Further, the unit 46, along with the slider 91, is inserted into the casing 1 and connected to the ribbon drive section 47. In doing this, the relay cores 102 in the connecting holes 66 formed individually in the respective shaft end portions 49*a*, 50*a*, 51*a* and 52*a* of the shafts 49, 50, 51 and 52 of the ribbon unit 46 are fitted on their corresponding rotating shafts 71, 72, 69 and 70 of the ribbon drive section 47. Thus, the projections 104 of each core 102 engage the grooves between the projections 84 of each of the rotating shafts 69, 70, 71 and 72, so that power transmission from the ribbon drive section 47 to the individual shafts 49 to 52 of the ribbon unit 46 is enabled.

As described above, the printer according to the present embodiment is provided with the supporting mechanism for supporting the ribbon unit on the body frame. By moving the slider of this supporting mechanism, the ribbon unit is moved between a first position where it is connected to the ribbon drive section and a second position where it is separated from the drive section and situated outside the body casing. Accordingly, the ribbon unit can be easily attached to or detached from the ribbon drive section. Also, the transfer ribbon can be replaced outside the casing. Thus, the working efficiency is considerably improved, and the ribbon unit can be utilized with high efficiency.

Further, the ribbon unit is retained on the slider by means of the engagement between the engaging pins and the ribbon supporting frame, and the slider is fixed by means of the retaining plates. Therefore, the printing can be satisfactorily effected without any play in the ribbon unit.

Furthermore, the relay core urged by means of the urging member is disposed in the connecting hole at each shaft end portion of each shaft of the ribbon unit, and a plurality of projections are formed on the inner surface of the relay core. Each rotating shaft of the ribbon drive section is provided with a plurality of projections adapted to engage the projections of the relay core, and the respective tip end portion of the projections of the relay core and the rotating shaft are tapered. Thus, if the respective tip end portions of these projections run against one another when the individual shafts of the ribbon unit are fitted on their corresponding rotating shafts of the ribbon drive section, the relay cores retreat against the urging force of the urging members, and the impulsive force is absorbed by the urging members. Moreover, the rotating shafts rotate so that the tapered end portions of their projections slide along the tapered projections of the relay cores to be disengaged therefrom. At this time, the relay cores are restored by means of the urging force of the urging members, and their projections engage their corresponding projections of the rotating shafts, whereupon the connection is completed.

Thus, the individual shafts of the ribbon unit can be securely connected to the rotating shafts of the ribbon drive section even when the respective tip end portions of their projections run against one another. If the tip end portions of the projections run against one another, moreover, the impulsive force is absorbed by the urging members, so that the impact acting on the ribbon drive section can be reduced.

If the ribbon set shaft is not fitted with the removable auxiliary positioning member, according to the ribbon unit constructed in this manner, the core for the transfer ribbon having the width substantially equal to the length of the ribbon set shaft can be mounted between the core positioning portion and the first core holding portion. If the ribbon set shaft is fitted with the auxiliary positioning member, the core for at least one type of transfer ribbon which is narrower than the ribbon having the width substantially equal to the set shaft length can be mounted between the auxiliary positioning member and the core holding portion. Thus, in the ribbon unit of the invention, various transfer ribbons conformable to various paper widths can be set for general-purpose use. Since it is unnecessary to use transfer ribbons of widths greater than the paper width, furthermore, the transfer ribbon can be used without waste for printing. Thus, the ribbon unit can be utilized with high efficiency.

Figure 20:
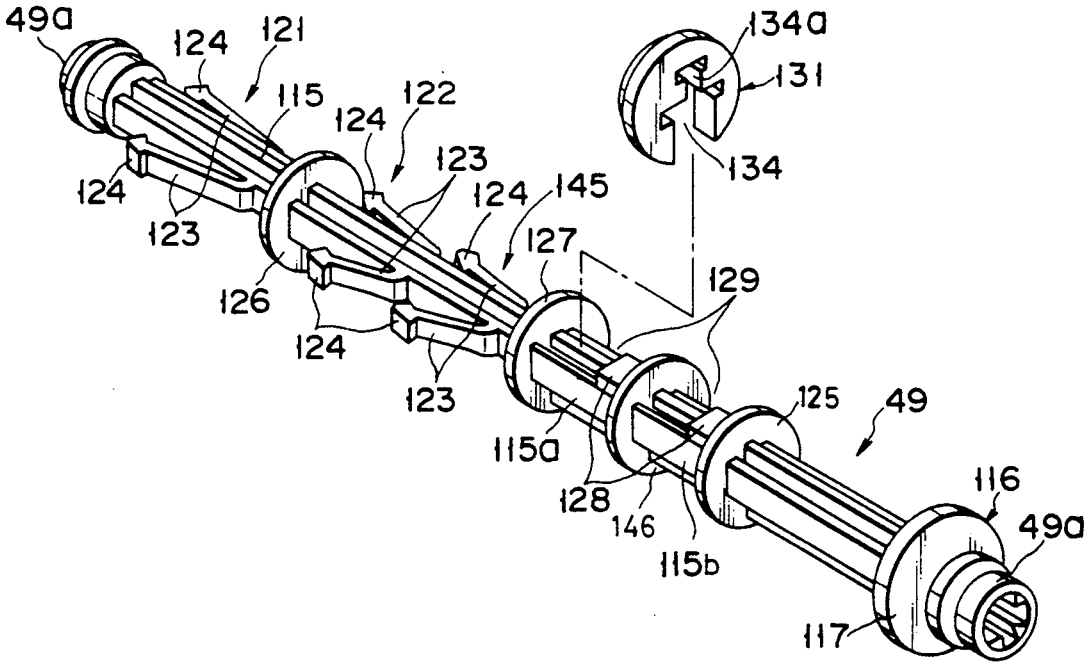
Figure 21:
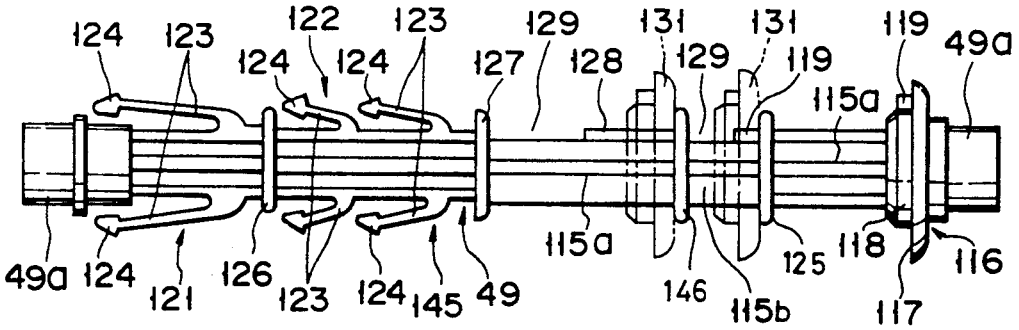

FIGS. 20 and 21 show a modification of the ribbon set shaft. In the description to follow, like reference numerals are used to designate the same portions as used in the foregoing embodiment, and a description of those identical portions is omitted.

In this modification, the ribbon set shaft 49 is provided with a third holding portion 145 besides the first and second holding portions 121 and 122. The third holding portion 145 is also formed of a pair of elastic arms 123 each having a hook portion 124 at the distal end thereof. Further, the shaft 49 is provided with a second engaging portion 146 and a second shaft portion 115*b* besides the first engaging portion 125 and the shaft end portion 49*a*. Since the engaging portion 146 and the shaft portion 115*b* are constructed in the same manner as the engaging portion 125 and the shaft portion 115*a*, respectively, a description of those second portions is omitted. Thus, the second shaft portion 115*b* includes the top portion 128 having the notch 129. The auxiliary positioning member 131, which is removably mounted on the shaft 49, can be positioned alternatively by means of the first or second engaging portion 125 or 146.

If the auxiliary positioning member 131 is not used in the arrangement, a core of 6-inch length can be removably held between the core positioning portion 116 and the first core holding portion 121. If the positioning member 131 is attached positioned to the second engaging portion 146, a core of 3-inch length can be removably held between the member 131 and the second core holding portion 122. If the member 131 is attached positioned to the first engaging portion 125, moreover, a core of 2-inch length can be removably held between the member 131 and the third core holding portion 145.

In the embodiment and modification described above, the cores of various lengths are located with respect to the center of the ribbon set shaft 49. Alternatively, however, the cores may be located with respect to the core positioning portion or the first core holding portion.

Figure 22:
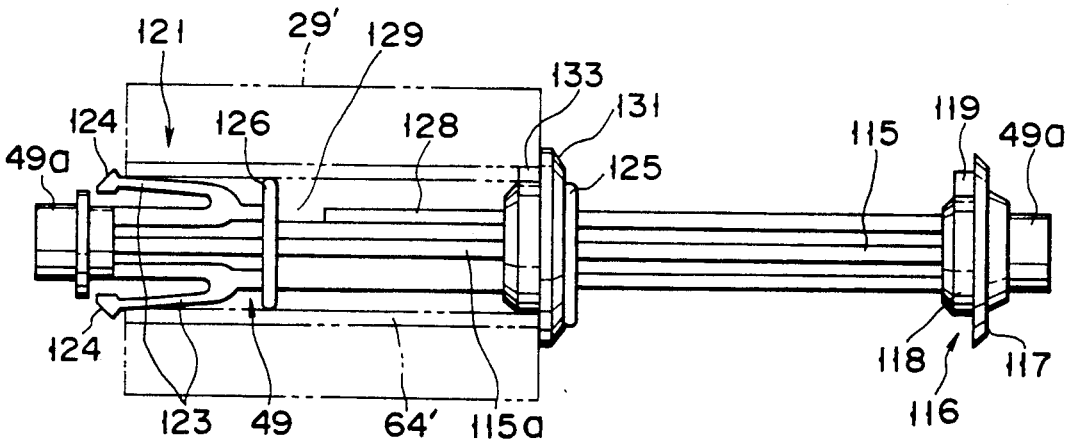
FIG. 22 is a plan view showing another modification of the ribbon set shaft.

In this case, as shown in FIG. 22, the engaging portion 125 is located at a distance substantially equal to the length of the core 64' from the first holding portion 121, for example. The core 64' is mounted on the ribbon set shaft 49 in a manner such that its opposite ends are individually in engagement with the first holding portion 121 and the positioning member 131 positioned by means of the engaging portion 125. In this case, the second holding portion 123 may be omitted.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A transfer printer comprising:

a main body;

printing means including a print head and a platen in contact with the print head;

the platen and print head being arranged in the main body, for printing information on a recording medium transported between the print head and the platen;

a transfer ribbon;

a ribbon supply device for supplying the transfer ribbon between the print head and the recording medium;

said ribbon supply device including:

a ribbon unit; and a ribbon drive section arranged in the main body, for driving the ribbon unit;

the ribbon unit including:

a ribbon supporting frame;

first and second rotating shafts rotatably supported on the ribbon supporting frame;

the transfer ribbon being wound around the first and second rotating shafts;

a tension shaft rotatably supported on the ribbon supporting frame and in contact with the transfer ribbon at a position between the first rotating shaft and the print head;

a ribbon drive shaft rotatably supported on the ribbon supporting frame and in contact with the transfer ribbon at a position between the second rotating shaft and the print head; and the first and second rotating shafts being detachably attached to the ribbon supporting frame for enabling replacement of the transfer ribbon; and supporting means for supporting the ribbon unit, the supporting means including:

a slider;

means for removably retaining the ribbon supporting frame on the slider;

the slider being movable between a first position where the ribbon unit engages the ribbon drive section and a second position where the ribbon unit is situated outside the main body so as to enable the replacement of the transfer ribbon and the detachment of the ribbon supporting frame from the slider;

the first and second rotating shafts, the tension shaft, and the ribbon drive shaft extending in a direction parallel to a longitudinal axis of the platen; and the first rotating shaft and the tension shaft being arranged symmetrically to the second rotating shaft and the ribbon drive shaft when viewed from an imaginary plane extending in a direction parallel to and between the first and second rotating shafts and between the tension shaft and the ribbon drive shaft; and said ribbon unit being mountable on the slider in a manner such that the first and second rotating shafts are replaced with each other and the tension shaft and the ribbon drive shaft are replaced with each other when the ribbon supporting frame is moved 180 degrees around an imaginary axis on an imaginary plane extending in a direction perpendicular to the first rotating shaft.

2. A printer according to claim 1, wherein said supporting means includes:

a fixed member fixed to the main body;

said slider being mounted on the fixed member so as to be movable between the first and second positions in a direction substantially parallel to a longitudinal axis of the platen.

3. A printer according to claim 2, wherein said main body includes:

a supporting frame having first and second side plates that face each other;

said platen extending between the first and second side plates; and said fixed member having one end thereof fixed to the first side plate and the other end thereof positioned close to the second side plate, and extending in a direction parallel to the longitudinal axis of the platen.

4. A printer according to claim 3, wherein said ribbon drive section is fixed to the first side plate and faces the ribbon unit mounted on the slider.

5. A printer according to claim 1, wherein said ribbon unit includes:

said slider having a supporting surface bearing the ribbon supporting frame thereon; and said means for removably retaining the ribbon supporting frame includes an engaging pin provided on the supporting surface of the slider and an engaging hole formed in the ribbon supporting frame, for engaging the engaging pin.

6. A printer according to claim 1, wherein said supporting means includes means for fixing the ribbon unit to the fixed member when the slider is moved to the first position.

7. A printer according to claim 1, wherein said ribbon drive section includes first and second drive shafts that are positioned to be coaxial with the first and second rotating shafts of the ribbon unit supported on the supporting means, the first and second rotating shafts of the ribbon unit individually having shaft end portions for respectively engaging the first and second drive shafts when the ribbon unit is moved to the first position, each rotating shaft end portion having impact absorbing means for absorbing an impact of engagement with the corresponding drive shaft.

8. A printer according to claim 7, wherein said impact absorbing means includes:

a connecting hole formed in each of the rotating shaft end portions;

each said connector hole opening toward the ribbon drive section;

a cylindrical relay core positioned in each connecting hole so as to be nonrotatable and movable in a direction parallel to a longitudinal axis of the first and second drive shafts;

an urging member disposed in the connecting hole for urging the relay core positioned in the connecting hole toward the ribbon drive section; and each of the first and second drive shafts being positioned in a respective one of said relay cores.

9. A printer according to claim 8, wherein: said relay core includes:

a plurality of projections formed on and spaced around an inner circumferential surface of the relay core to be spaced in the circumferential direction, said projections extending in an axial direction of the relay core; and each of said first and second drive shafts has a tip end portion that fits in the relay core, and a plurality of projections formed on an outer peripheral surface of the tip end portion so as to individually engage with the plurality of projections formed on the relay core;

the tip end portion of each of the plurality of projections formed on the relay core, on a side of the ribbon drive section being tapered and each projection formed on the tip end portion of the first and second drive shafts on a side of the ribbon unit also being tapered.

10. A transfer printer comprising:

a main body;

printing means including a print head and a platen in contact with the print head;

the print head and platen being arranged in the main body, for printing information on a recording medium transported between the print head and the platen;

a ribbon supply device for supplying a transfer ribbon between the print head and the recording medium;

said ribbon supply device including a ribbon unit and a ribbon drive section for driving the ribbon unit, arranged in the main body, the ribbon unit including:

a ribbon supporting frame;

first and second rotating shafts rotatably supported on the ribbon supporting frame;

the transfer ribbon being wound around the first and second rotating shafts;

a tension shaft rotatably supported on the ribbon supporting frame and in contact with the transfer ribbon at a position between the first rotating shaft and the printer head; and a ribbon drive shaft rotatably supported on the ribbon supporting frame and in contact with the transfer ribbon at a position between the second rotating shaft and the print head;

said first and second rotating shafts, the tension shaft, and the ribbon drive shaft extending in a direction parallel to a longitudinal axis of the platen; and said first rotating shaft and the tension shaft are arranged symmetrically to the second rotating shaft and the ribbon drive shaft when viewed from an imaginary plane extending in a direction parallel to and between the first and second rotating shafts and between the tension shaft and the ribbon drive shaft; and supporting means for supporting the ribbon unit, the supporting means including:

a fixed member arranged in the main body;

a slider carrying the ribbon unit thereon; and means for removably retaining the ribbon unit on the slider;

the slider being engageable with the fixed member and being movable between a first position where the ribbon unit engages the ribbon drive section and a second position where the ribbon unit is situated outside the main body; and said ribbon unit being mountable on the slider in a manner such that the first and second rotating shafts are replaced with each other and the tension shaft and the ribbon drive shaft are replaced with each other when the ribbon supporting frame is moved 180 degrees around an imaginary axis on an imaginary plane extending perpendicular to the first rotating shaft.

11. A transfer printer comprising:

a main body;

printing means including a print head and a platen in contact with the print head, which are arranged in the main body, for printing information on a recording medium transported between the print head and the platen;

a transfer ribbon; and a ribbon supply device for supplying the transfer ribbon between the print head and the recording medium, said ribbon supply device including a ribbon unit, removably attached to the main body and having the transfer ribbon and supply and take-up shafts wound with the transfer ribbon, and a ribbon drive section attached to the main body, for driving the ribbon unit;

each of the supply shaft and the take-up shaft of the ribbon unit including:

a ribbon set shaft;

a cylindrical first core removably mounted on the ribbon set shaft to extend in a direction substantially parallel thereto and wound with the transfer ribbon, the cylindrical first core having a predetermined length;

positioning means provided at one end portion of the ribbon set shaft, for engaging one end of the first core mounted on the ribbon set shaft so as to position the one end of the first core with respect to the ribbon set shaft;

holding means provided at the other end portion of the ribbon set shaft and situated at a distance substantially equal to the predetermined length of the first core from the positioning means, for elastically engaging another end of the first core to hold another end of the first core;

an engaging portion provided on the ribbon set shaft between the positioning means and the holding means;

a cylindrical second core adapted to be mounted on the ribbon set shaft in place of the first core and wound with another transfer ribbon narrower than the first transfer ribbon, the second core being shorter than the predetermined length of the first core and having one end portion for engaging the holding means; and auxiliary positioning means removably mounted on the ribbon set shaft and positioned by the engaging portion provided on the ribbon set shaft, for engaging another end portion of the second core mounted on the ribbon set shaft so as to position the another end of the second core.

12. A printer according to claim 11, wherein said positioning means includes a disk-shaped flange formed on the ribbon set shaft to be substantially coaxial therewith and engaging the one end of the first core, and a ring-shaped fitting portion formed on the flange, for fitting into the one end portion of the first core, and said holding means includes a plurality of elastically deformable arms, extending from the ribbon set shaft on a side opposite to the positioning means and in a direction receding from the ribbon set shaft, and hooks formed individually on the respective extended ends of the arms, for engaging the other end of the first core.

13. A printer according to claim 12, wherein said auxiliary positioning means includes a disk-shaped body for engaging another end of the second core and the engaging portion, a columnar fitting portion protruding coaxially from the disk-shaped body, for fitting into another end portion of the second core, and a fitting recess formed in the disk-shaped body and the fitting portion, for mating with the ribbon set shaft.

14. A printer according to claim 13, wherein said engaging portion comprises a disk smaller than the first core and formed coaxially with the ribbon set shaft.

15. A printer according to claim 14, wherein said engaging portion is situated at a distance substantially equal to the length of the second core from the holding means.

16. A printer according to claim 14, wherein each said ribbon set shaft includes second holding means arranged between the first holding means and the engaging portion, for elastically engaging the one end of the second core to hold the one end of the second core, and said engaging portion is situated at a distance substantially equal to the length of the second core from the second holding means.

17. A printer according to claim 16, wherein said second holding means includes a plurality of elastically deformable arms, extending from the ribbon set shaft on a side opposite to the positioning means and in a direction to recede from the ribbon set shaft, and hooks formed individually on the respective extended ends of the arms, for engaging the other end of the second core.

18. A printer according to claim 16, wherein each of said supply shaft and said take-up shaft includes a second engaging portion provided on the ribbon set shaft between the first engaging portion and the second holding means; a cylindrical third core adapted to be mounted on the ribbon set shaft in place of the first core and wound with still another transfer ribbon narrower than the second transfer ribbon, the third core being shorter in length than the first core and having one end portion for engaging the auxiliary positioning means mounted on the ribbon set shaft to be positioned by the second engaging portion; and third holding means provided on the ribbon set shaft between the second holding means and the second engaging portion, for engaging another end of the third core to hold the other end of the third core.

19. A printer according to claim 11, which further comprises supporting means arranged in the main body, for supporting the ribbon unit so that the ribbon unit is movable between a first position when the ribbon unit engages the ribbon drive section and a second position when the ribbon unit is situated outside the main body.

20. A printer according to claim 19, wherein said ribbon unit is removably mounted on the supporting means.

21. A transfer printer according to claim 1, wherein:

said first and second rotating shafts, the tension shaft, and the ribbon drive shaft respectively have a first and a second end portion;

the first end portions of the first and second rotating shafts, the tension shaft and the ribbon drive shaft being engageable with the ribbon drive section when the ribbon supporting frame is mounted on the slider in a first state;

the second end portions of the first and second rotating shafts, the tension shaft and the ribbon drive shaft being engageable with the ribbon drive section when the ribbon supporting frame is mounted on the slider in a second state; and the ribbon supporting frame being movable through 180 degrees from the first state about an axis that is perpendicular to the first and second rotating shafts.

* * * * *